US008904762B2

(12) United States Patent
Suzuki et al.

(10) Patent No.: US 8,904,762 B2
(45) Date of Patent: Dec. 9, 2014

(54) CONTROL APPARATUS FOR AN INTERNAL COMBUSTION ENGINE

(75) Inventors: Kenji Suzuki, Susono (JP); Shuntaro Okazaki, Sunto-gun (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 13/882,622

(22) PCT Filed: Mar. 10, 2011

(86) PCT No.: PCT/JP2011/055631

§ 371 (c)(1),
(2), (4) Date: Apr. 30, 2013

(87) PCT Pub. No.: WO2012/120676

PCT Pub. Date: Sep. 13, 2012

(65) Prior Publication Data

US 2013/0340410 A1 Dec. 26, 2013

(51) Int. Cl.

| | |
|---|---|
| ***F01N 3/00*** | (2006.01) |
| ***F01N 3/08*** | (2006.01) |
| ***F02D 41/00*** | (2006.01) |
| ***F02D 41/14*** | (2006.01) |
| *F02D 41/02* | (2006.01) |

(52) U.S. Cl.

CPC ..... *F01N 3/08* (2013.01); *F02D 41/0032* (2013.01); *F02D 41/1441* (2013.01); *F02D 41/0295* (2013.01); *F02D 41/0045* (2013.01)

USPC ..... 60/285; 60/283; 60/286; 60/295; 123/520; 123/686

(58) Field of Classification Search

USPC ..... 60/283, 285, 286, 295; 123/518, 520, 123/521, 686, 689

See application file for complete search history.

(56) References Cited

U.S. PATENT DOCUMENTS

| | | | |
|---|---|---|---|
| 5,487,270 | A | 1/1996 | Yamashita et al. |
| 6,438,945 | B1 * | 8/2002 | Takagi et al. ..... 60/283 |

(Continued)

FOREIGN PATENT DOCUMENTS

| | | |
|---|---|---|
| DE | 10 2006 004 837 A1 | 8/2007 |
| EP | 1 167 726 A2 | 1/2002 |
| JP | A-06-010737 | 1/1994 |

(Continued)

OTHER PUBLICATIONS

Aug. 25, 2014, Search Report issued in European Patent Application No. 11860368.7.

*Primary Examiner* — Binh Q Tran
(74) *Attorney, Agent, or Firm* — Oliff PLC

(57) ABSTRACT

An embodiment (control apparatus) for an internal combustion engine according to the present invention determines, based on an output value of the downstream air-fuel ratio sensor disposed downstream of a three-way catalyst, determines which air-fuel ratio request, a rich request or a lean request, is occurring. The control apparatus sets a target upstream air-fuel ratio to a target rich air-fuel ratio when the rich request is occurring, and sets the target upstream air-fuel ratio to a target lean air-fuel ratio when the lean request is occurring. Each of the target rich air-fuel ratio and the target lean air-fuel ratio is varied depending on an intake air amount. Further, the control apparatus increases a purge amount of an evaporated fuel as a magnitude (air-fuel ratio change amount ΔAF, |afLean−afRich|) of a difference between the target rich air-fuel ratio and the target lean air-fuel ratio becomes larger.

3 Claims, 12 Drawing Sheets

(56) References Cited

U.S. PATENT DOCUMENTS

| | | | | |
|---|---|---|---|---|
| 7,033,322 | B2 * | 4/2006 | Silver | 600/486 |
| 7,305,978 | B2 * | 12/2007 | Osanai | 123/686 |
| 8,028,517 | B2 * | 10/2011 | Demura | 60/295 |
| 8,220,250 | B2 * | 7/2012 | Hokuto | 60/285 |

FOREIGN PATENT DOCUMENTS

| | | |
|---|---|---|
| JP | A-06-264798 | 9/1994 |
| JP | A-2002-081350 | 3/2002 |
| JP | A-2004-100623 | 4/2004 |
| JP | A-2009-162139 | 7/2009 |

* cited by examiner

CONTROL APPARATUS FOR AN INTERNAL COMBUSTION ENGINE

TECHNICAL FIELD

The present invention relates to a control apparatus for an internal combustion engine, having a three-way catalyst disposed in an exhaust passage, an evaporated fuel purge section configured to introduce evaporated fuel generated in a fuel tank into an intake passage, and a fuel injection valve configured to supply fuel.

BACKGROUND ART

Conventionally, a three-way catalyst is disposed/provided in an exhaust passage of an internal combustion engine to purify an exhaust gas discharged from the engine. As is well known, the three-way catalyst has an oxygen storage function. That is, the three-way catalyst stores oxygen and reduces NOx when a gas flowing into the there-way catalyst (catalyst inflow gas) contains excessive oxygen. When the catalyst inflow gas contains excessive unburnt substance, the three-way catalyst releases the stored oxygen to purify the unburnt substance. Hereinafter, the three-way catalyst is also referred to as a "catalyst."

A conventional air-fuel ratio control apparatus (conventional apparatus) comprises an upstream air-fuel ratio sensor and a downstream air-fuel ratio sensor, disposed upstream and downstream of the catalyst, respectively, in the exhaust passage of the engine. The conventional apparatus controls an air-fuel ratio (air-fuel ratio of the engine) of a mixture supplied to the engine in such a manner that an air-fuel ratio (detected upstream air-fuel ratio) represented by an output value of the upstream air-fuel ratio sensor coincides with a target upstream air-fuel ratio. This control is also referred to as a "main feedback control."

Further, the conventional apparatus calculates a sub feedback amount so as to have an output value of the downstream air-fuel ratio sensor coincide with a "target value corresponding to the stoichiometric air-fuel ratio", and controls the air-fuel ratio of the engine by substantially changing the target upstream air-fuel ratio based on the sub feedback amount (see, for example, patent literature No. 1). This air-fuel ratio control using the sub feedback amount is also referred to as a "sub feedback control."

CITATION LIST

Patent Literature

<Patent Literature No. 1> Japanese Patent Application Laid-Open (kokai) No. 2009-162139

SUMMARY OF THE INVENTION

In the meantime, the applicant is developing an air-fuel ratio control apparatus which can maintain emissions at a preferable level especially when the "oxygen storage capacity of the catalyst is low (e.g., when a maximum oxygen storage amount is small such as when the catalyst has deteriorated, or when the oxygen storage capacity itself is small)". For example, one of such air-fuel ratio control apparatuses being developed determines a state (oxygen storage state) of the catalyst based on the output value of the downstream air-fuel ratio sensor without delay, and controls the air-fuel ratio of the engine in such a manner that an air-fuel ratio of the catalyst inflow gas coincide with an air-fuel ratio other than the stoichiometric air-fuel ratio based on a result of the determination.

More specifically, such a control apparatus sets a target upstream air-fuel ratio (target air-fuel ratio of the catalyst inflow gas) to a "target rich air-fuel ratio smaller than the stoichiometric air-fuel ratio", when the apparatus determines, based on the output value Voxs of the downstream air-fuel ratio sensor, that a state/condition of the catalyst becomes an oxygen excess state (lean state). Further, the control apparatus sets the target upstream air-fuel ratio to a "target lean air-fuel ratio larger than the stoichiometric air-fuel ratio", when the apparatus determines, based on the output value Voxs of the downstream air-fuel ratio sensor, that the state/condition of the catalyst becomes an oxygen shortage state (rich state).

In addition, the control apparatus changes the target rich air-fuel ratio and the target lean air-fuel ratio based on an operating state of the engine so as to avoid that a drivability worsens because of an engine vibration caused by a large fluctuation of a generated torque of the engine due to a rapid/sudden change in the air-fuel ratio of the engine. That is, for example, the target rich air-fuel ratio and the target lean air-fuel ratio are made closer to the stoichiometric air-fuel ratio so that a difference between the target lean air-fuel ratio and the target rich air-fuel ratio becomes smaller in an operating state in which the drivability easily worsens. Further, there may be a case in which the control apparatus changes the target rich air-fuel ratio and the target lean air-fuel ratio from the different view point even when it is unlikely that the drivability worsens.

Meanwhile, the engine may adopt an evaporated fuel purge section. The evaporated fuel purge section has a canister, which adsorbs an evaporated fuel generated in a fuel tank, and which introduces the evaporated fuel adsorbed in the canister into an intake passage of the engine when a predetermined condition is satisfied. Accordingly, the evaporated fuel is burnt in a combustion chamber of the engine, and thereafter, is discharged into the air. The introduction of the evaporated fuel into the intake passage of the engine is referred to an evaporated fuel purge or a purge. The purge is one of factors that change the air-fuel ratio of the engine. Typically, the control apparatus estimates, based on the output value of the upstream air-fuel ratio sensor, a concentration of the evaporated fuel which is purged, and adjusts a fuel injection amount in accordance with the estimated concentration of the evaporated fuel in order to avoid a "large change in the air-fuel ratio of the engine due to the evaporated fuel purge." It is not easy, however, to estimate the concentration of the evaporated fuel with high accuracy. Therefore, if the purge is started when the estimation accuracy of the concentration of the evaporated fuel is not high, the air-fuel ratio of the engine may greatly vary, whereby the emission may worsen.

The present invention is made to cope with the above described problem. That is, one of the objects of the present invention is to provide a control apparatus for an internal combustion engine, which can reduce a degree of worsening of the emission when the evaporated fuel pure is carried out.

The control apparatus (the present invention apparatus) for an internal combustion engine according to the present invention comprises:

a catalyst disposed in an exhaust passage of the engine;

a downstream air-fuel ratio sensor disposed downstream of the catalyst in the exhaust passage;

a target air-fuel ratio setting section configured so as to set, based on an output value of the downstream air-fuel ratio sensor, a target upstream air-fuel ratio which is a "target value of an air-fuel ratio of a gas flowing into the catalyst" to a target rich air-fuel ratio and a target lean air-fuel ratio, alternately;

a fuel injection valve configured so as to inject a fuel to the engine;

a fuel injection control section configured so as to determine a "fuel injection amount which is an amount of the fuel injected from the fuel injection valve" in accordance with the target upstream air-fuel ratio, and so as to have the fuel injection valve inject the fuel of the determined fuel injection amount;

an evaporated fuel purge section configured so as to introduce an evaporated fuel generated in a fuel tank storing the fuel supplied to the fuel injection valve into an intake passage of the engine; and an evaporated fuel purge amount control section configured so as to control a purge amount which is an amount of the evaporated fuel introduced into the intake passage by the evaporated fuel purge section.

Further, in the present invention apparatus, the target air-fuel ratio setting section is configured:

so as to set the target rich air-fuel ratio to a first target rich air-fuel ratio smaller than the stoichiometric air-fuel ratio and set the target lean air-fuel ratio to a first target lean air-fuel ratio larger than the stoichiometric air-fuel ratio, when an operating state indicating value indicative of an operating state of the engine is equal to a first value; and so as to set the target rich air-fuel ratio to a second target rich air-fuel ratio smaller than the first target rich air-fuel ratio and set the target lean air-fuel ratio to a second target lean air-fuel ratio larger than the first target lean air-fuel ratio, when the operating state indicating value indicative of the operating state of the engine is equal to a second value different from the first value.

In this case, for example, the operating state indicating value may be an intake air amount of the engine (value corresponding to a load of the engine), an engine rotational speed, a temperature of the catalyst (degree of an activation), a "value corresponding to an amount of the evaporated fuel adsorbed in a canister (e.g., an evaporated fuel gas concentration learning value)" described later, and so on.

Further, the evaporated fuel purge amount control section of the present invention is configured so as to increase the purge amount as a magnitude of a difference between the target lean air-fuel ratio and the target rich air-fuel ratio becomes larger.

In other words, the evaporated fuel purge amount control section controls the purge amount in such a manner that the purge amount when the operating state indicating value is equal to the second value becomes larger than the purge amount when the operating state indicating value is equal to the first value.

In the present invention apparatus, the target rich air-fuel becomes smaller and the target lean air-fuel ratio becomes larger, as the magnitude of the difference between the target lean air-fuel ratio and the target rich air-fuel ratio becomes larger.

Accordingly, in the present invention apparatus, when it is determined that the state of the catalyst is the oxygen excess state, an "exhaust gas having an air-fuel ratio which becomes smaller" as the magnitude of the difference between the target lean air-fuel ratio and the target rich air-fuel ratio becomes larger flows into the catalyst. Therefore, the oxygen storage amount of the catalyst can be rapidly decreased by a large amount of the unburnt substances contained in that exhaust gas.

Further, in the present invention apparatus, when it is determined that the state of the catalyst is the oxygen shortage state, an "exhaust gas having an air-fuel ratio which becomes larger" as the magnitude of the difference between the target lean air-fuel ratio and the target rich air-fuel ratio becomes larger flows into the catalyst. Therefore, the oxygen storage amount of the catalyst can be rapidly increased by a large amount of the oxygen contained in that exhaust gas.

Accordingly, in the present invention apparatus, a time period in which the oxygen storage amount is maintained at the "maximum oxygen storage amount Cmax" or "0" (that is, a time duration in which the emission worsens) becomes shorter, even if a large amount of the evaporated fuel is purged, and thus, the air-fuel ratio of the catalyst inflow gas greatly fluctuates. Consequently, the present invention apparatus can carry out the purge of the evaporated fuel while maintaining the possibility that the emission worsens at a low level.

In one of aspects of the present invention apparatus, the evaporated fuel purge section includes a canister, which is disposed in a purge passage communicating between the fuel tank and the intake passage, and which adsorbs the evaporated fuel generated in the fuel tank.

The canister retains an adsorbent material, such as activated carbon, for adsorbing the evaporated fuel. Accordingly, there is an upper limit (canister saturated evaporated fuel amount) on an amount of the evaporated fuel which the canister can adsorb. Therefore, an amount of the evaporated fuel which the canister can further adsorb becomes smaller, as an amount of the evaporated fuel which the canister has adsorbed comes closer to the canister saturated evaporated fuel amount. Thus, it is preferable to increase an amount of the evaporated fuel which the canister can further adsorb by increasing the purge amount.

In view of the above, the target air-fuel ratio setting section obtains, as the operating state indicating value, an estimated adsorbed amount of the evaporated fuel which is a value corresponding to an amount of the evaporated fuel adsorbed in the canister.

Further, the target air-fuel ratio setting section determines that the operating state indicating value is equal to the first value when the estimated adsorbed amount of the evaporated fuel is smaller than a predetermined amount. As a result, the target rich air-fuel ratio is set to the first target rich air-fuel ratio, and the target lean air-fuel ratio is set to the first target lean air-fuel ratio.

Furthermore, the target air-fuel ratio setting section determines that the operating state indicating value is equal to the second value when the estimated adsorbed amount of the evaporated fuel is equal to or larger than the predetermined amount. As a result, the target rich air-fuel ratio is set to the second target rich air-fuel ratio, and the target lean air-fuel ratio is set to the second target lean air-fuel ratio.

According to the configuration described above, the purge amount can be increased as an amount of the evaporated fuel adsorbed in the canister (estimated adsorbed amount of the evaporated fuel) comes closer to the canister saturated evaporated fuel amount, and thus, it is possible to provide the canister with a capacity to adsorb a "certain (fair) amount of the evaporated fuel." Thus, even when a large amount of the evaporated fuel suddenly/rapidly generates in the fuel tank, there is a high possibility of causing such an evaporated fuel to be adsorbed into the canister. Consequently, a possibility that the evaporated fuel is discharged into the air can be reduced.

Another aspect of the present invention apparatus is configured so as to comprise:

a catalyst disposed in an exhaust passage of an internal combustion engine;

a downstream air-fuel ratio sensor disposed downstream of the catalyst in the exhaust passage;

a target air-fuel ratio setting section configured so as to set, based on an output value of the downstream air-fuel ratio sensor, a target upstream air-fuel ratio which is a "target value of an air-fuel ratio of a gas flowing into the catalyst" to a target rich air-fuel ratio and a target lean air-fuel ratio, alternately;

a fuel injection valve configured so as to inject a fuel to the engine;

a fuel injection control section configured so as to determine a fuel injection amount which is an amount of the fuel injected from the fuel injection valve in accordance with the target upstream air-fuel ratio, and so as to have the fuel injection valve inject the fuel of the determined fuel injection amount;

an evaporated fuel purge section configured so as to introduce an evaporated fuel generated in a fuel tank storing the fuel supplied to the fuel injection valve into an intake passage of the engine; and an evaporated fuel purge amount control section configured so as to control a purge amount which is an amount of the evaporated fuel introduced into the intake passage by the evaporated fuel purge section, wherein, the evaporated fuel purge section includes a canister, which is disposed in a purge passage communicating between the fuel tank and the intake passage, and which adsorbs the evaporated fuel generated in the fuel tank;

the target air-fuel ratio setting section is configured:

so as to obtain an estimated adsorbed amount of the evaporated fuel which is a value indicative of an amount of the evaporated fuel adsorbed in the canister;

so as to set the target rich air-fuel ratio to a first target rich air-fuel ratio smaller than the stoichiometric air-fuel ratio and set the target lean air-fuel ratio to a first target lean air-fuel ratio larger than the stoichiometric air-fuel ratio, when the estimated adsorbed amount of the evaporated fuel is smaller than a predetermined amount;

so as to set the target rich air-fuel ratio to a second target rich air-fuel ratio smaller than the first target rich air-fuel ratio and set the target lean air-fuel ratio to a second target lean air-fuel ratio larger than the first target lean air-fuel ratio, when the estimated adsorbed amount of the evaporated fuel is equal to or larger than the predetermined amount, and the evaporated fuel purge amount control section is configured so as to increase the purge amount as a magnitude of a difference between the target lean air-fuel ratio and the target rich air-fuel ratio becomes larger.

According to the configuration described above, in a case in which the estimated adsorbed amount of the evaporated fuel is equal to or larger than the predetermined amount, the target rich air-fuel ratio is set to an air-fuel ratio which becomes smaller (second target rich air-fuel ratio) and the target lean air-fuel ratio is set to an air-fuel ratio which becomes larger (second target lean air-fuel ratio), compared with a case in which the estimated adsorbed amount of the evaporated fuel is smaller than the predetermined amount. In this case, since the magnitude of the difference between the target lean air-fuel ratio and the target rich air-fuel ratio becomes larger, the purge amount is increased.

Accordingly, the purge amount can be increased, as an amount of the evaporated fuel which is adsorbed in the canister (estimated adsorbed amount of the evaporated fuel) comes closer to the canister saturated evaporated fuel amount. Thus, it is possible to provide the canister with a capacity to adsorb a "certain (fair) amount of the evaporated fuel." Therefore, even when a large amount of the evaporated fuel suddenly/rapidly generates in the fuel tank, there is a high possibility of causing such an evaporated fuel to be adsorbed into the canister. Consequently, a possibility that the evaporated fuel is discharged into the air can be reduced. In addition, as the purge amount becomes larger, the magnitude of the difference between the target lean air-fuel ratio and the target rich air-fuel ratio becomes larger, and therefore, a change speed of the air-fuel ratio of the catalyst inflow gas becomes larger. Consequently, a "possibility that the emission worsens due to the purge" can be reduced.

Other objects, features, and advantages of the present invention apparatus will be readily understood from the following description of each of embodiments of the present invention apparatus with reference to the accompanying drawings.

DESCRIPTION OF EMBODIMENTS

A control apparatus (hereinafter, simply referred to as a "control apparatus") for an internal combustion engine according to each of embodiments of the present invention will be described with reference to the drawings. This control apparatus is a portion of an air-fuel ratio control apparatus for controlling an air-fuel ratio of a mixture supplied to the internal combustion engine (air-fuel ratio of the engine), and is also a portion of a fuel injection amount control apparatus for controlling a fuel injection amount or a portion of an evaporated fuel purge amount control apparatus for controlling an evaporated fuel purge amount.

First Embodiment

Configuration

Figure 1:
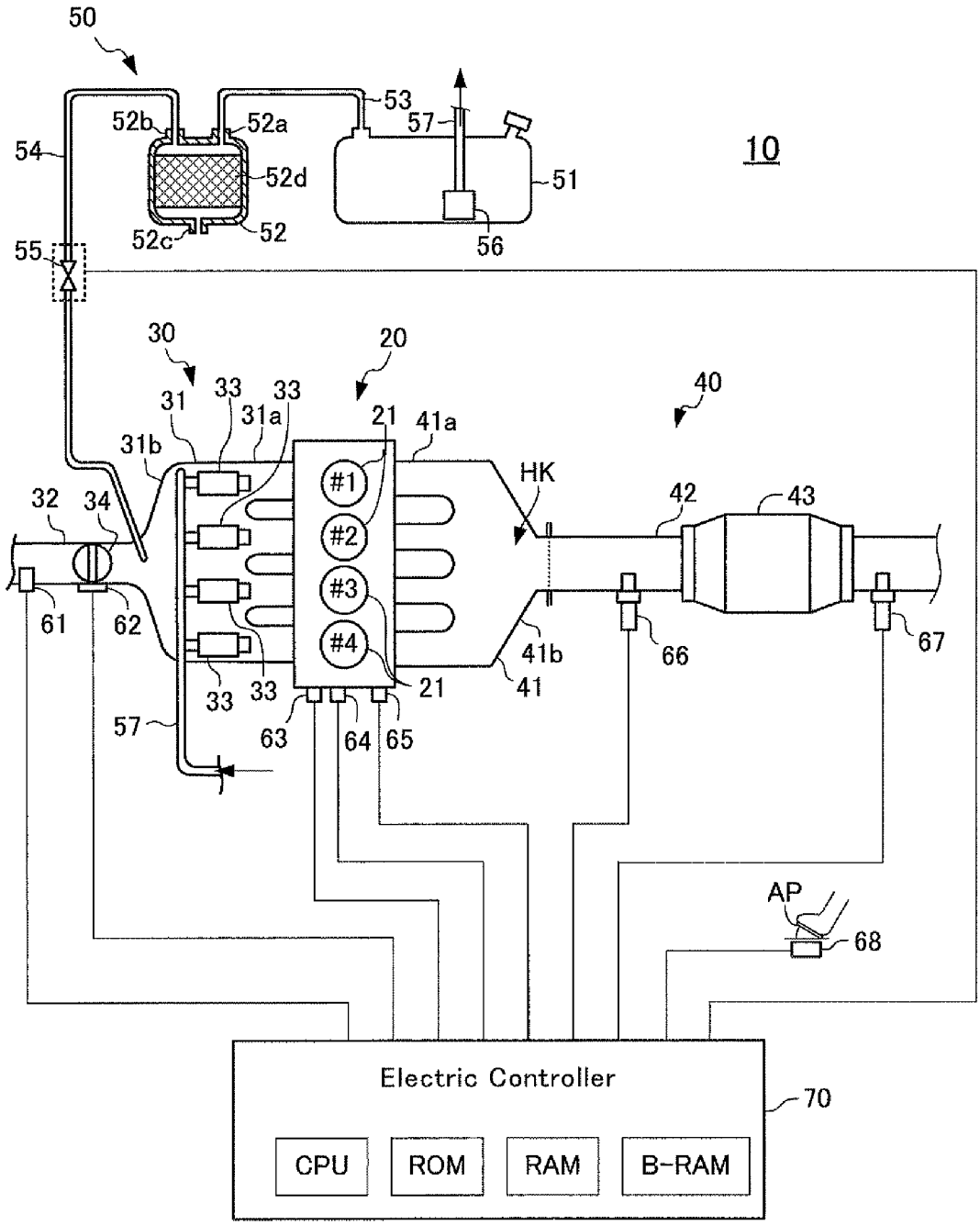
FIG. 1 is a schematic plan view of an internal combustion engine to which a control apparatus according to each of embodiments of the present invention is applied.

FIG. 1 schematically shows a configuration of a system configured such that a control apparatus (hereinafter, referred to as a "first control apparatus") according to a first embodiment is applied to a spark-ignition multi-cylinder (straight 4-cylinder) four-cycle internal combustion engine 10.

The internal combustion engine 10 includes a main body section 20, an intake system 30, an exhaust system 40, and an evaporated fuel supplying system 50.

The main body section 20 includes a cylinder block section and a cylinder head section. The main body section 20 has a plurality of cylinders (combustion chambers) 21. Each of the cylinders communicates with unillustrated "intake ports and exhaust ports." The communicating portions between the intake ports and the combustion chambers are opened and closed by unillustrated intake valves. The communicating portions between the exhaust ports and the combustion chambers are opened and closed by unillustrated exhaust valves. Each of the combustion chambers 21 is provided with a spark plug.

The intake system 30 comprises an intake manifold 31, an intake pipe 32, a plurality of fuel injection valves 33, and a throttle valve 34.

The intake manifold 31 includes a plurality of branch portions 31*a* and a surge tank 31*b*. An end of each of a plurality of the branch portions 31*a* is connected to each of a plurality of the intake ports. The other end of each of a plurality of the branch portions 31*a* is connected to the surge tank 31*b*.

An end of the intake pipe 32 is connected to the surge tank 31*b*. An unillustrated air filter is provided at the other end of the intake pipe 32.

Each of the fuel injection valves 33 is provided for each of the cylinders (combustion chambers) 21. The fuel injection valve is disposed in the intake port. That is, each of a plurality of the cylinders comprises the fuel injection valve 33 for supplying the fuel independently from the other cylinders. The fuel injection valve 33 is configured so as to inject, in response to an injection instruction signal, a "fuel of an instructed injection amount included in the injection instruction signal" into the intake port (and thus, to the cylinder 21 corresponding to that fuel injection valve 33), when that fuel injection valve 33 is normal.

More specifically, a fuel is supplied to the fuel injection valve 33 through a fuel supply pipe 57 connected to a fuel tank described later. A pressure of the fuel supplied to the fuel injection valve 33 is adjusted in such a manner that a difference between the pressure of the fuel and a pressure in the intake port is constant by means of an unillustrated pressure regulator. The fuel injection valve 33 is opened for a time duration corresponding to the instructed fuel injection amount. Accordingly, when the fuel injection valve 33 is normal, the fuel injection valve 33 injects the fuel of an amount equal to the instructed fuel injection amount.

The throttle valve 34 is provided in the intake pipe 32 so as to be rotated. The throttle valve 34 is adapted to change an opening cross sectional area of the intake passage. The throttle valve 34 is rotated within the intake pipe 32 by an unillustrated throttle valve actuator.

The exhaust system 40 includes an exhaust manifold 41, an exhaust pipe 42, an upstream-side catalyst 43 disposed in the exhaust pipe 42, and an "unillustrated downstream-side catalyst" disposed downstream of the upstream catalyst 43 in the exhaust pipe 42.

The exhaust manifold 41 comprises a plurality of branch portions 41*a* and an aggregated (merging) portion 41*b*. An end of each of a plurality of branch portions 41*a* is connected to each of the exhaust ports. The other end of each of a plurality of branch portions 41*a* is connected to the aggregated portion 41*b*. This aggregated portion 41*b* is a portion into which the exhaust gases discharged from a plurality of (two or more of, and in the present example, four of) the cylinders aggregate (merge), and therefore, is referred to as an exhaust gas aggregated portion HK.

The exhaust pipe 42 is connected to the aggregated portion 41*b*. The exhaust ports, the exhaust manifold 41, and the exhaust pipe 42 constitute an exhaust passage.

Each of the upstream catalyst 43 and the downstream catalyst is a so-called three-way catalyst unit (catalyst for purifying exhaust gas) carrying an active component formed of noble metals (catalytic substances) such as platinum, rhodium, and palladium. Each of the catalysts has a function of oxidizing unburned combustibles (substances) such as HC, CO, and $H_2$ and reducing nitrogen oxides (NOx) when an air-fuel ratio of a gas flowing into each of the catalysts is an "air-fuel ratio within a window of the three-way catalyst (e.g., stoichiometric air-fuel ratio)." This function is also called a "catalytic function."

Furthermore, each of the catalysts has an oxygen storage function of occluding (storing) oxygen. That is, each of the catalysts stores oxygen and purifies NOx when the gas flowing into the catalyst (catalyst in-flow gas) contains excessive oxygen. When the catalyst in-flow gas contains excessive unburned substances, each of the catalysts releases the stored oxygen to purify the unburned substances. The oxygen storage function is realized by an oxygen storing substances such as ceria ($CeO_2$) carried by the catalyst. Each of the catalyst can purify the unburned substances and the nitrogen oxides even when the air-fuel ratio deviates from the stoichiometric air-fuel ratio, owing to the oxygen storage function. That is, the oxygen storage function expands a width of the window.

The evaporated fuel supplying system 50 includes the fuel tank 51, a canister 52, a vapor collecting pipe 53, a purge flowing passage pipe 54, a purge control valve 55, and a fuel pump 56.

The fuel tank 51 stores the fuel which is injected/supplied to the engine 10 from the fuel injection valves 33.

The canister 52 is a "well-known charcoal canister" which adsorbs the evaporated fuel (evaporated fuel gas) generated in the fuel tank 51. The canister 52 comprises a casing/housing which has a tank port 52*a*, a purge port 52*b*, an atmosphere port 52*c* exposed to the air, that are formed therein. The canister 52 accommodates (retains) an adsorbent material (e.g., activated carbon, or the like) 52*d* for adsorbing the evaporated fuel in its casing.

One of ends of the vapor collecting pipe 53 is connected to an upper portion the fuel tank 51, and the other of the ends of the vapor collecting pipe 53 is connected to the tank port 52*a*. The vapor collecting pipe 53 is a pipe for introducing the evaporated fuel generated in the fuel tank 51 from the fuel tank into the canister 52.

One of ends of the purge flowing passage pipe 54 is connected to the purge port 52*b*, and the other of the ends of the purge flowing passage pipe 54 is connected to the surge tank 31*b* (that is, the intake passage downstream of the throttle valve 34). The purge flowing passage pipe 54 is a pipe for introducing the evaporated fuel released from the adsorbent material of the canister 52 into the surge tank 31*b*. The vapor collecting pipe 53 and the purge flowing passage pipe 54 constitute a purge passage (purge passage section).

The purge control valve 55 is disposed in the purge flowing passage pipe 54. The purge control valve 55 is configured so as to change an opening cross sectional area of the purge flowing passage pipe 54 by changing a valve opening (valve opening period) in accordance with a duty ratio DPG serving as an instruction signal. The purge control valve 55 is configured so as to completely close the purge flowing passage pipe 54, when the duty ratio DPG is equal to "0."

The fuel pump 56 is configured so as to supply the fuel stored in the fuel tank to the fuel injection valves 33 through the fuel supply pipe 57.

In the thus configured evaporated fuel supplying system 50, the evaporated fuel generated in the fuel tank 51 is adsorbed in the canister 52 when the purge control valve 55 is fully closed. The evaporated fuel adsorbed in the canister 52 is released to the surge tank 41*b* (intake passage downstream of the throttle valve 34) through the purge flowing passage pipe 54 to be supplied to the combustion chambers 21 (engine 10), when the purge control valve 55 is opened. That is, when the purge control valve 55 is opened, the purge of the evaporated fuel (referred also to as "evaporated fuel purge" or "purge") is carried out.

This system includes a hot-wire air-flow meter 61, a throttle position sensor 62, a water temperature sensor 63, a crank position sensor 64, an intake-cam position sensor 65, an upstream air-fuel ratio sensor 66, a downstream air-fuel ratio sensor 67, and an accelerator opening sensor 68.

The air-flow meter 61 is designed so as to output a signal corresponding to a mass flow rate (intake air flow rate) Ga of an intake air flowing through the intake pipe 32. That is, the intake air flow rate Ga represents an amount of an intake air taken into the engine 10 per unit time.

The throttle position sensor 62 detects an opening of the throttle valve 34 (throttle valve opening), and outputs a signal representing the detected throttle valve opening TA.

The water temperature sensor 63 detects a temperature of a cooling water of the internal combustion engine 10, and outputs a signal representing the detected cooling water temperature THW. The cooling water temperature THW is an operating state indicating value representing a warming state of the engine 10 (temperature of the engine 10).

The crank position sensor 64 outputs a signal including a narrow pulse generated every time the crankshaft rotates 10° and a wide pulse generated every time the crankshaft rotates 360°. This signal is converted to an engine rotational speed NE by an electric controller 70 which will be described later.

The intake-cam position sensor 65 outputs a single pulse when the intake camshaft rotates 90 degrees from a predetermined angle, when the intake camshaft rotates 90 degrees after that, and when the intake camshaft further rotates 180 degrees after that. Based on the signals from the crank position sensor 64 and the intake-cam position sensor 65, the electric controller 70 described later obtains an absolute crank angle CA, while using, as a reference, a compression top dead center of a reference cylinder (e.g., the first cylinder). This absolute crank angle CA is set to "0° crank angle" at the compression top dead center of the reference cylinder, increases up to 720° crank angle in accordance with the rotational angle of the crank shaft, and is again set to 0° crank angle at that point in time.

The upstream air-fuel ratio sensor 66 is disposed in "either one of the exhaust manifold 41 and the exhaust pipe 42" and at a position between the aggregated portion 41*b* (exhaust gas merging/aggregated portion HK) of the exhaust manifold 41 and the upstream catalyst 43.

The upstream air-fuel ratio sensor 66 is a "limiting-current-type wide range air-fuel ratio sensor including a diffusion resistance layer" disclosed in, for example, Japanese Patent Application Laid-Open (kokai) Nos. H11-72473, 2000-65782, and 2004-69547.

Figure 2:
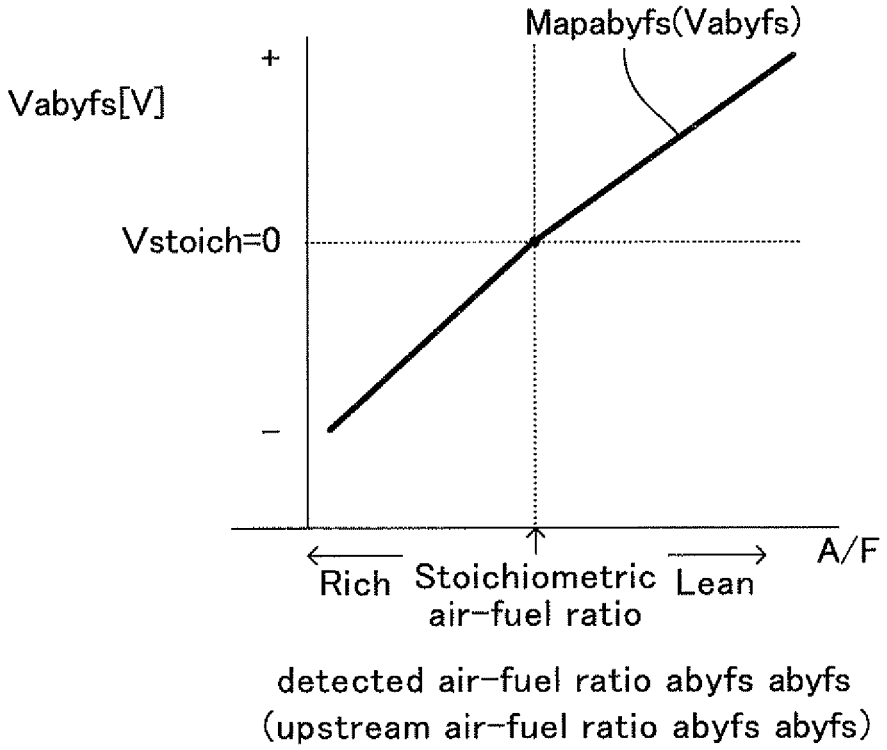
FIG. 2 is a graph showing a relationship between an air-fuel ratio of a gas flowing into the catalyst shown in FIG. 1 and an output value of the upstream air-fuel ratio sensor shown in FIG. 1.

The upstream air-fuel ratio sensor 66 outputs an output value Vabyfs which varies depending on an air-fuel ratio (air-fuel ratio of the "catalyst inflow gas" flowing into the catalyst 43, upstream air-fuel ratio abyfs) of the exhaust gas flowing through the disposed position at which the upstream air-fuel ratio sensor 66 is disposed. As shown in FIG. 2, the output value Vabyfs becomes larger as the air-fuel ratio of the catalyst inflow gas (upstream air-fuel ratio abyfs) becomes larger (becomes a leaner air-fuel ratio).

The electric controller 70 stores an air-fuel ratio conversion table (map) Mapabyfs shown in FIG. 2, which defines a relationship between the output value Vabyfs and the upstream air-fuel ratio abyfs. The electric controller 70 detects an actual upstream air-fuel ratio (or obtains a detected upstream air-fuel ratio abyfs) by applying the output value Vabyfs to the air-fuel ratio conversion table Mapabyfs.

Referring back to FIG. 1, the downstream air-fuel ratio sensor 67 is disposed in the exhaust pipe 42. A disposed position at which the downstream air-fuel ratio sensor 67 is disposed is downstream of the upstream catalyst 43 and upstream of the downstream catalyst (i.e., in the exhaust passage between the upstream catalyst 43 and the downstream catalyst). The downstream air-fuel ratio sensor 67 is a well-known electro-motive-force-type oxygen concentration sensor (a well-known concentration-cell-type oxygen concentration sensor using stabilized zirconia, or the like). The downstream air-fuel ratio sensor 67 is designed to generate an output value Voxs corresponding to an air-fuel ratio of a gas to be detected, the gas flowing through a portion of the exhaust passage where the downstream air-fuel ratio sensor 67 is disposed. In other words, the output value Voxs is a value corresponding to the air-fuel ratio of the gas which flows out from the upstream catalyst 43 and flows into the downstream catalyst.

Figure 3:
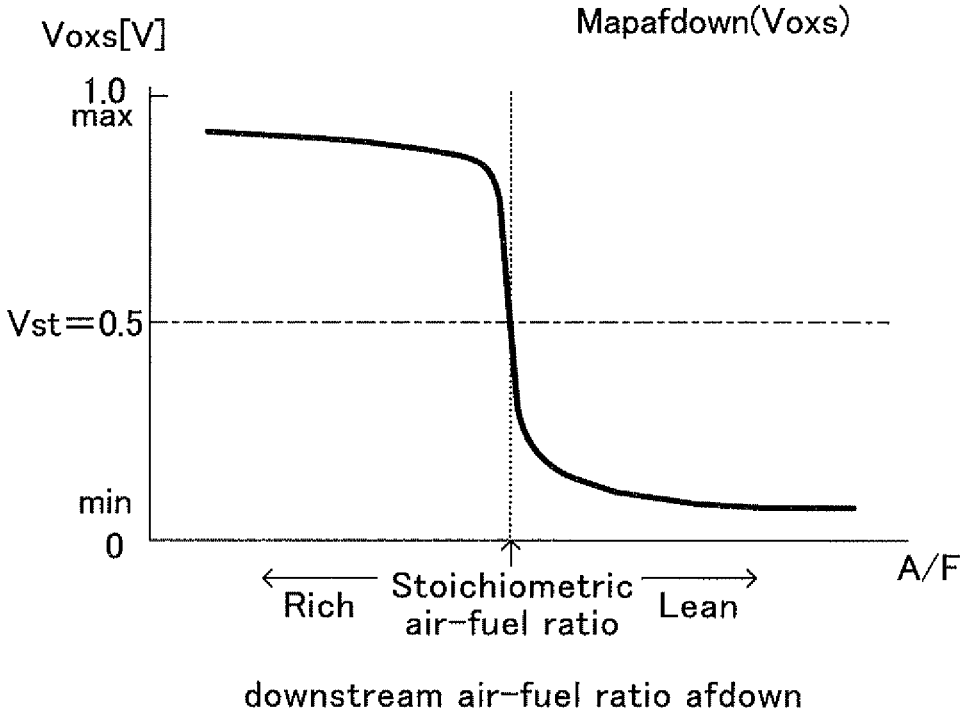
FIG. 3 is a graph showing a relationship between an air-fuel ratio of a gas flowing out form the catalyst shown in FIG. 1 and an output value of the downstream air-fuel ratio sensor shown in FIG. 1.

As shown in FIG. 3, this output value Voxs becomes a maximum output value max (e.g., about 0.9 V-1.0 V) when the air-fuel ratio of the gas to be detected is richer than the stoichiometric air-fuel ratio. The output value Voxs becomes a minimum output value min (e.g., about 0.1 V to 0 V) when the air-fuel ratio of the gas to be detected is leaner than the stoichiometric air-fuel ratio. Further, the output value Voxs becomes a voltage Vst (middle value Vmid, midpoint voltage Vst, e.g., about 0.5 V) which is approximately the midpoint value between the maximum output value max and the minimum output value min when the air-fuel ratio of the gas to be detected is equal to the stoichiometric air-fuel ratio. Further, the output value Vox drastically changes from the maximum output value max to the minimum output value min when the air-fuel ratio of the gas to be detected changes from the air-fuel ratio richer than the stoichiometric air-fuel ratio to the air-fuel ratio leaner than the stoichiometric air-fuel ratio. Similarly, the output value Vox drastically changes from the minimum output value min to the maximum output value max when the air-fuel ratio of the gas to be detected changes from the air-fuel ratio leaner than the stoichiometric air-fuel ratio to the air-fuel ratio richer than the stoichiometric air-fuel ratio.

The accelerator opening sensor 68 shown in FIG. 1 is designed to output a signal indicative of an operation amount Accp of an accelerator pedal AP operated by the driver (accelerator pedal operation amount, opening degree of the accelerator pedal AP). The accelerator pedal operation amount Accp becomes larger as the operation amount of the accelerator pedal AP becomes larger.

The electric controller 70 is a well-known microcomputer which includes "a CPU; a ROM in which programs executed by the CPU, tables (maps and/or functions), constants, etc. are stored in advance; a RAM in which the CPU temporarily stores data as needed; a backup RAM (B-RAM); and an interface which includes an AD converter, etc."

The backup RAM is supplied with an electric power from a battery mounted on a vehicle on which the engine 10 is mounted, regardless of a position (off-position, start position, on-position, and so on) of an unillustrated ignition key switch of the vehicle. While the electric power is supplied to the backup RAM, data is stored in (written into) the backup RAM according to an instruction of the CPU, and the backup RAM holds (retains, stores) the data in such a manner that the data can be read out. Accordingly, the backup RAM can keep the data while the engine 10 is stopped.

When the battery is taken out from the vehicle, for example, and thus, when the backup RAM is not supplied with the electric power, the backup RAM can not hold the data. Accordingly, the CPU initializes the data to be stored (sets the data to default values) in the backup RAM when the electric power starts to be supplied to the backup RAM again. The backup RAM may be replaced with a nonvolatile readable and writable memory such as an EEPROM.

The electric controller 70 is connected to sensors described above so as to send signals from those sensors to the CPU. In addition, the electric controller 70 is designed to send drive signals (instruction signals) to each of the spark plugs (in actuality, the igniters) provided for each of the cylinders, each of the fuel injection valves 33 provided for each of the cylinders, the throttle valve actuator, and the like, in response to instructions from the CPU.

The electric controller 70 is designed to send the instruction signal to the throttle valve actuator so that the throttle valve opening TA increases as the obtained accelerator pedal operation amount Accp increases. That is, the electric controller 70 has a throttle valve drive section for changing the opening of the "throttle valve 34 disposed in the intake passage of the engine 10" in accordance with the acceleration operation amount (accelerator pedal operation amount Accp) of the engine 10 which is changed by the driver.

(An Outline of Operations of the First Control Apparatus)

The first control apparatus determines, based on the output value Voxs of the downstream air-fuel ratio sensor 67, whether the sate of the catalyst 43 (oxygen storage state) is an oxygen excess state or an oxygen shortage state (wherein, the oxygen excess state being a lean state in which the oxygen storage amount of the catalyst 43 becomes a value in the vicinity of the maximum oxygen storage amount Cmax, that is, a state in which the oxygen storage amount of the catalyst 43 is equal to or larger than a higher side threshold, and the oxygen shortage state being a rich state in which the catalyst 43 stores little or no oxygen, that is, a state in which the oxygen storage amount of the catalyst 43 is equal to or smaller than a "lower side threshold which is smaller than the high side threshold").

More specifically, the first control apparatus determines that the state of the catalyst 43 has become the oxygen shortage state, when a change amount ΔVoxs of the output value Voxs per a predetermined time is a positive value, and a magnitude |ΔVoxs| of it becomes larger than a rich determining threshold dRichth, while it is determined that the state of the catalyst 43 is the oxygen excess state. Further, the first control apparatus determines that the state of the catalyst 43 has become the oxygen excess state, when the change amount ΔVoxs of the output value Voxs per the predetermined time is a negative value, and the magnitude |ΔVoxs| of it becomes larger than a lean determining threshold dLeanth, while it is determined that the state of the catalyst 43 is the oxygen shortage state.

It should be noted that the first control apparatus may determine that the state of the catalyst 43 becomes the oxygen shortage state, when the output value Voxs becomes larger than a rich determining threshold VRichth while it is determined that the state of the catalyst 43 is the oxygen excess state. Further, the first control apparatus may determine that the state of the catalyst 43 becomes the oxygen excess state, when the output value Voxs becomes smaller than a lean determining threshold VLeanth while it is determined that the state of the catalyst 43 is the oxygen shortage state.

When it is determined that the state of the catalyst 43 is the oxygen shortage state, the first control apparatus sets a target value (i.e., target upstream air-fuel ratio abyfr) of the air-fuel ratio of the catalyst inflow gas to a "target lean air-fuel ratio afLean larger than the stoichiometric air-fuel ratio."

When it is determined that the state of the catalyst 43 is the oxygen excess state, the first control apparatus sets the target value (i.e., target upstream air-fuel ratio abyfr) of the air-fuel ratio of the catalyst inflow gas to a "target rich air-fuel ratio afRich smaller than the stoichiometric air-fuel ratio."

Figure 4:
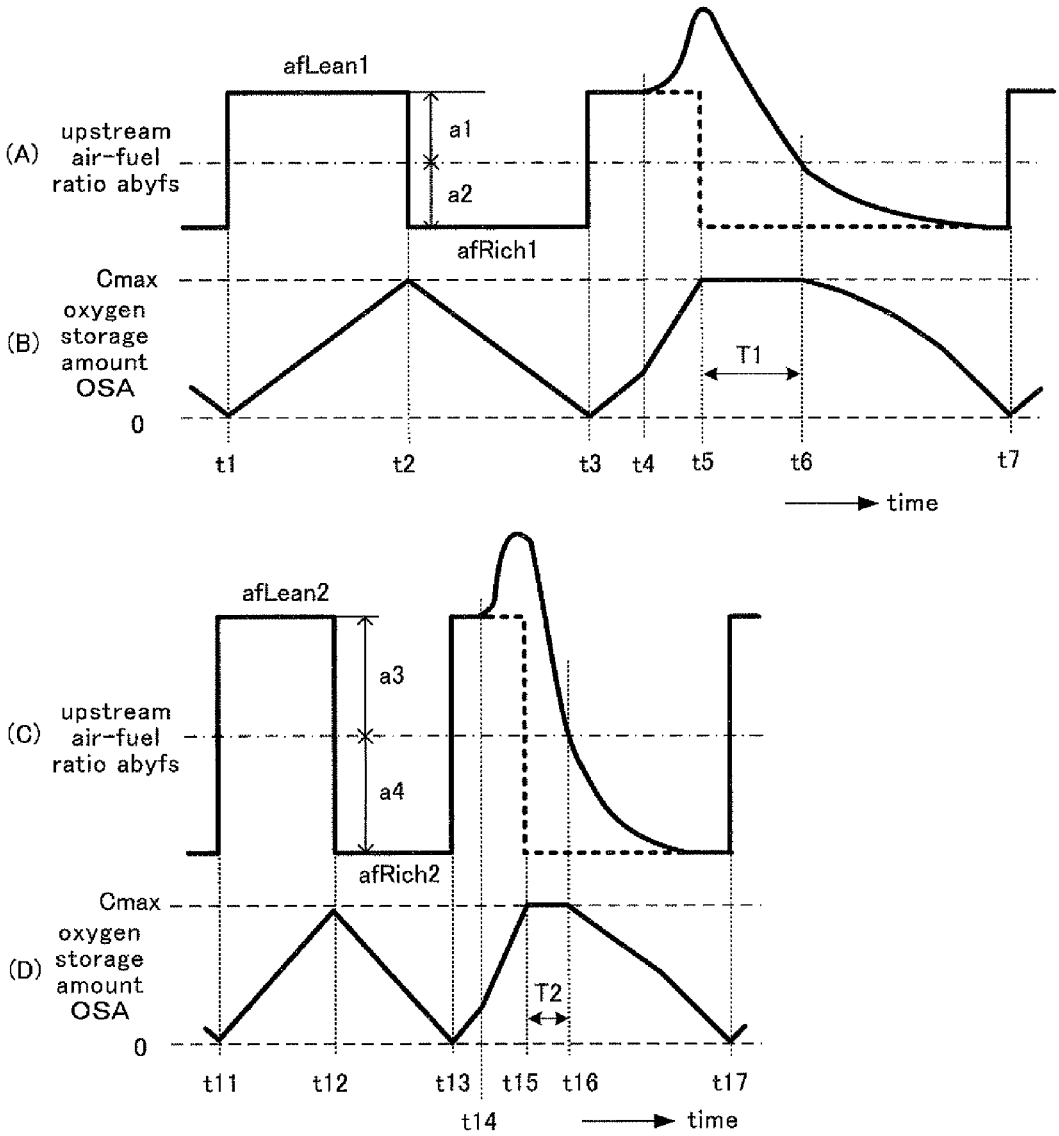
FIG. 4 is a timeline chart showing behaviors of an upstream air-fuel ratio and an oxygen storage amount of the catalyst.

The target lean air-fuel ratio afLean is not constant, but varies depending on the intake air flow amount Ga serving as the parameter (operating state indicating value) indicative of the operating state of the engine. That is, as shown in (A) of FIG. 4, the target lean air-fuel ratio afLean is set to a first target lean air-fuel ratio afLean1 (=stoichiometric air-fuel ratio+a1) when the air flow amount Ga is a first value. Further, as shown in (C) of FIG. 4, the target lean air-fuel ratio afLean is set to a "second target lean air-fuel ratio afLean2 (=stoichiometric air-fuel ratio+a3, a3>a1>0) larger than the first target lean air-fuel ratio afLean1" when the air flow amount Ga is a "second value different from the first value."

The target rich air-fuel ratio afRich is not constant, but varies depending on the intake air flow amount Ga serving as the parameter (operating state indicating value) indicative of the operating state of the engine. That is, as shown in (A) of FIG. 4, the target rich air-fuel ratio afRich is set to a first target rich air-fuel ratio afRich1 (=stoichiometric air-fuel ratio−a2) when the air flow amount Ga is the first value. Further, as shown in (C) of FIG. 4, the target rich air-fuel ratio afRich is set to a "second target rich air-fuel ratio afRich2 (=stoichiometric air-fuel ratio+a4, a4>a2>0) smaller than the first target rich air-fuel ratio afRich1" when the air flow amount Ga is the "second value different from the first value."

It should be noted that the value a1 may be equal to or different from the value a2. Similarly, the value a3 may be equal to or different from the value a4.

Meanwhile, when a predetermined purge condition is satisfied, the first control apparatus opens the purge control valve 55 so as to introduce the evaporated fuel into the intake passage (carry out the purge of the evaporated fuel). The purge of the evaporated fuel greatly disturbs the air-fuel ratio of the catalyst inflow gas in a case in which a correction of the fuel injection amount is not sufficient, or the like. That is, an impact/influence on the air-fuel ratio the purge of the evaporated fuel has can be compensated by correcting the fuel injection amount. However, when the fuel injection amount is not sufficiently corrected/decreased, the air-fuel ratio of the catalyst inflow gas becomes excessively large. Accordingly, the emission may worsen when the purge of the evaporated fuel is started.

In the first control apparatus, a magnitude (=|afLean−afRich|) of a difference between the target lean air-fuel ratio afLean and the target rich air-fuel ratio afRich becomes a magnitude |a1+a2| of a difference between the first target lean air-fuel ratio afLean1 and the first target rich air-fuel ratio afRich1 when the intake air amount Ga is the first value, and becomes a magnitude |a3+a4| of a difference between the second target lean air-fuel ratio afLean2 and the second target rich air-fuel ratio afRich2 when the intake air amount Ga is the second value. The value |a3+a4| is larger than the value |a1+a2|. That is, in the first control apparatus, as the magnitude (=|afLean−afRich|) of the difference between the target lean air-fuel ratio afLean and the target rich air-fuel ratio afRich becomes larger, the target rich air-fuel ratio afRich becomes smaller and the target lean air-fuel ratio afLean becomes larger.

Accordingly, in the first control apparatus, as the magnitude (=|afLean−afRich|) of the difference between the target lean air-fuel ratio afLean and the target rich air-fuel ratio afRich becomes larger, the "exhaust gas having the smaller air-fuel ratio" flows into the catalyst 43 when it is determined that the state of the catalyst 43 is the oxygen excess state, and thus, the oxygen storage amount of the catalyst 43 can be promptly decreased owing to a great amount of the unburned substances contained in that exhaust gas. Further, in the first control apparatus, as the magnitude (=|afLean−afRich|) of the difference between the target lean air-fuel ratio afLean and the target rich air-fuel ratio afRich becomes larger, the "exhaust gas having the larger air-fuel ratio" flows into the catalyst 43 when it is determined that the state of the catalyst 43 is the oxygen shortage state, and thus, the oxygen storage amount of the catalyst 43 can be promptly increased owing to a great amount of oxygen contained in that exhaust gas.

Consequently, in the case where the magnitude (=|afLean−afRich|) of the difference between the target lean air-fuel ratio afLean and the target rich air-fuel ratio afRich is large, a period in which the oxygen storage amount of the catalyst 43 is maintained at the "maximum oxygen storage amount Cmas" or "0" (that is, a time duration in which the emission worsens) does not become long, even when a large amount of the evaporated fuel is purged (evaporated fuel purge amount is increased) (refer to a period T1 and a period T2, shown in FIG. 2).

Further, the catalyst can store a greater amount of oxygen as the air-fuel ratio of the catalyst inflow gas becomes larger, and can release a greater amount of oxygen as the air-fuel ratio of the catalyst inflow gas becomes smaller. That is, the maximum oxygen storage amount increases so that the purifying capacity of the catalyst is enhanced, as the magnitude (=|afLean−afRich|) of the difference between the target lean air-fuel ratio afLean and the target rich air-fuel ratio afRich becomes larger.

In view of the above, the first control apparatus control the opening degree (duty ratio DPG) of the purge control valve in such a manner that an amount of the evaporated fuel which is purged becomes larger, as the magnitude (=|afLean−afRich|) of the difference between the target lean air-fuel ratio afLean and the target rich air-fuel ratio afRich becomes larger. Consequently, the first control apparatus can purge the evaporated fuel while maintaining a possibility that the emission worsens at a low level.

(Actual Operation)

An actual operation of the first control apparatus will next be described.

<Fuel Injection Amount Control>

Figure 5:
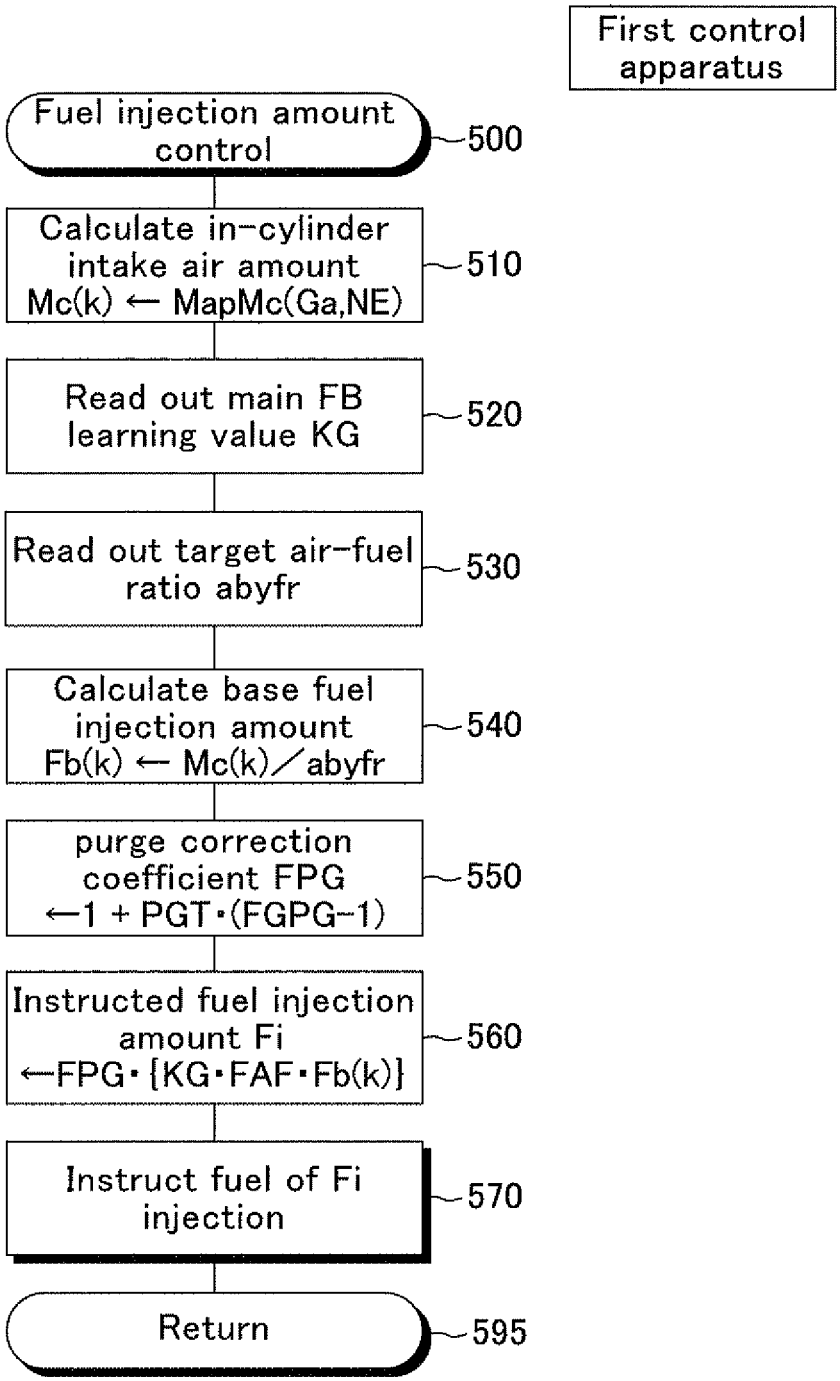
FIG. 5 is a flowchart showing a routine executed by a CPU of a control apparatus (first control apparatus) according to a first embodiment of the present invention.

The CPU of the first control apparatus is designed to repeatedly execute a fuel injection amount control routine shown in FIG. 5 for an arbitrary cylinder (hereinafter, also referred to as a "fuel injection cylinder"), each time the crank angle of the arbitrary cylinder becomes a predetermined crank angle before the intake top dead center (for example, BTDC 90° CA).

Accordingly, at an appropriate point in time, the CPU starts processing from step 500 to sequentially execute processes from step 510 to step 570, and thereafter proceeds to step 595 to end the present routine tentatively.

Step 510: The CPU obtains an amount of an intake air currently introduced into the fuel injection cylinder (in-cylinder intake air amount) Mc(k) by applying "the intake air amount Ga measured by the air-flow meter 61, and the engine rotational speed NE" to a look-up table MapMc. The in-cylinder intake air amount Mc(k) is stored in the RAM, while being related to the intake stroke of each cylinder.

Step 520: The CPU reads out a main FB learning value (main feedback learning value) KG from the backup RAM. The main FB learning value KG is separately obtained by a main feedback learning routine shown in FIG. 8 described later, and is stored in the backup RAM.

Step 530: The CPU reads out the target upstream air-fuel ratio abyfr (=abyfr(k)) separately obtained by a target upstream air-fuel ratio setting routine shown in FIG. 6 described later from the RAM.

Step 540: As shown in a formula (1) described below, the CPU obtains a base fuel injection amount Fb(k) by dividing the in-cylinder intake air amount Mc(k) by the target upstream air-fuel ratio abyfr which was read out at step 530. The base fuel injection amount Fb(k) is stored in the RAM, while being related to each intake stroke.

$$Fb(k)=Mc(k)/abyfr \tag{1}$$

Step 550: The CPU obtains a purge correction coefficient FPG according to a formula (2) described below. In the formula (2), PGT is a target purge rate. The target purge rate PGT is obtained at step 935 shown in FIG. 9 described later. FGPG is an evaporated fuel gas concentration learning value. The evaporated fuel gas concentration learning value FGPG is obtained in a routine shown in FIG. 10 described later, and is stored in the backup RAM.

$$FPG=1+PGT(FGPG-1) \tag{2}$$

Step 560: The CPU corrects the base fuel injection amount Fb(k) according to a formula (3) described below to obtain an instructed fuel injection amount Fi which is an instruction value of a final fuel injection amount Fi. The values in the right side of the formula (3) are as follows. Those values are separately obtained in routines described later.

FPG: Purge correction coefficient

KG: Main FB learning value KG

FAF: Main feedback coefficient updated by a main feedback control $$Fi=FPG\cdot[KG\cdot FAF\cdot Fb(k)] \tag{3}$$

Step 570: The CPU sends the instruction signal to the fuel injection valve 33 corresponding to the fuel injection cylinder so as to have that fuel injection valve 33 inject a fuel of the instructed fuel injection amount Fi.

<Setting of the Target Upstream Air-Fuel Ratio>

Figure 6:
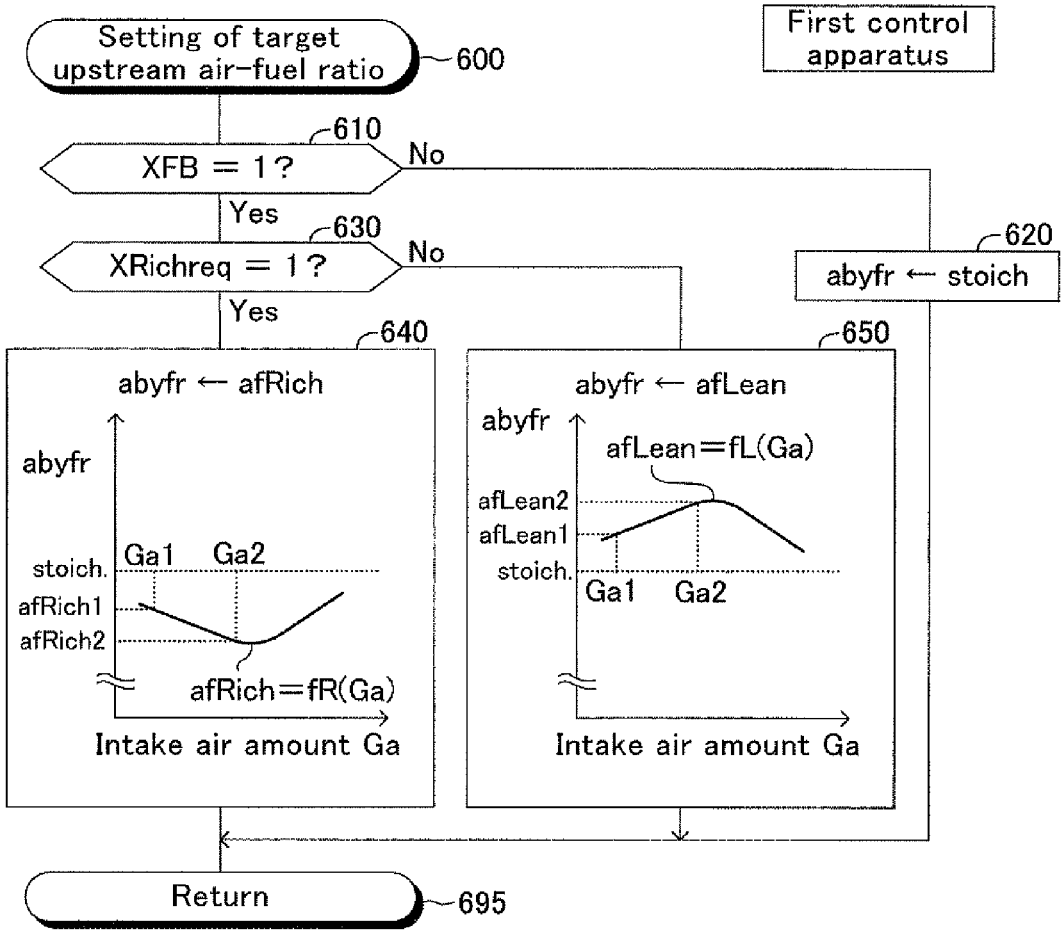
FIG. 6 is a flowchart showing a routine executed by the CPU of the first control apparatus.

The CPU repeatedly executes the "target upstream air-fuel ratio setting routine" shown by a flowchart in FIG. 6, every time a predetermined time period elapses. Accordingly, at an appropriate point in time, the CPU starts the process from step 600 to determine whether or not a value of a feedback control flag XFB is "1,"

The value of the feedback control flag XFB is set to "1" when a feedback control condition is satisfied, and set to "0" when the feedback control condition is not satisfied. In other words, the value of the feedback control flag XFB is set to "1" when a feedback control of the air-fuel ratio (a main feedback control and a sub feedback control) is being performed. The feedback control condition is satisfied when all of the following conditions are satisfied, for example.

(A1) The upstream air-fuel ratio sensor 66 has been activated.

(A2) The downstream air-fuel ratio sensor 67 has been activated.

(A3) The load KL of the engine is smaller than or equal to a threshold value KLth.

If the value of the feedback control flag XFB is not "1", the CPU makes a "No" determination at step 610 to proceed to step 620, at which the CPU sets the target upstream air-fuel ratio abyfr to the stoichiometric air-fuel ratio stoich (e.g., 14.6). Thereafter, the CPU proceeds to step 695 to end the present routine tentatively.

If the value of the feedback control flag XFB is "1" when the CPU executes the process of step 610, the CPU makes a "Yes" determination at step 610 to proceed to step 630, at which the CPU determines whether or not a value of a rich request flag XRichreq is "1." The value of the rich request flag XRichreq is set to either "1" or "0" by an air-fuel ratio request (catalyst state) determination routine shown in FIG. 11 described later.

The rich request flag XRichreq indicates, when the value of the flag XRichreq is "1", that the state of the catalyst 43 is the oxygen excess state, and thus, the excessive unburned substances should be made to flow into the catalyst 43. That is, the air-fuel ratio request is a rich request. The rich request flag XRichreq indicates, when the value of the flag XRichreq is "0", that the state of the catalyst 43 is the oxygen shortage state, and thus, the excessive oxygen should be made to flow into the catalyst 43. That is, the air-fuel ratio request is a lean request. Step 630 may be replaced with a step at which the CPU determines whether or not the "state of the catalyst 43 is the oxygen excess state."

When the value of the rich request flag XRichreq is "1", the CPU makes a "Yes" determination at step 630 to proceed to step 640, at which the CPU determines the target rich air-fuel ratio afRich (which is smaller than the stoichiometric air-fuel ratio) based on the intake air amount Ga, and sets the target upstream air-fuel ratio abyfr (=present target air-fuel ratio abyfr(k)) to the target rich air-fuel ratio afRich.

At step 640, the target rich air-fuel ratio afRich is determined so as to become a first target rich air-fuel ratio afRich1 when the intake air amount Ga is a first value Ga1, and to become a "second target rich air-fuel ratio afRich2 smaller than the first target rich air-fuel ratio afRich1" when the intake air amount Ga is a "second value different from (larger than) the first value Ga1," Thereafter, the CPU proceeds to step 695 to end the present routine tentatively.

In contrast, if the value of the rich request flag XRichreq is "0" when the CPU executes the process of step 630, the CPU makes a "No" determination at step 630 to proceed to step 650, at which the CPU determines the target lean air-fuel ratio afLean (which is larger than the stoichiometric air-fuel ratio) based on the intake air amount Ga, and sets the target upstream air-fuel ratio abyfr (=present target air-fuel ratio abyfr(k)) to the target lean air-fuel ratio afLean.

At step 650, the target lean air-fuel ratio afLean is determined so as to become a first target lean air-fuel ratio afLean1 when the intake air amount Ga is the first value Ga1, and to become a "second target lean air-fuel ratio afLean2 larger than the first target lean air-fuel ratio afLean1" when the intake air amount Ga is the "second value different from (larger than) the first value Ga1." Thereafter, the CPU proceeds to step 695 to end the present routine tentatively. It should be noted that the target upstream air-fuel ratio abyfr is stored in the RAM, while being related to each intake stroke.

<Main Feedback Control>

Figure 7:
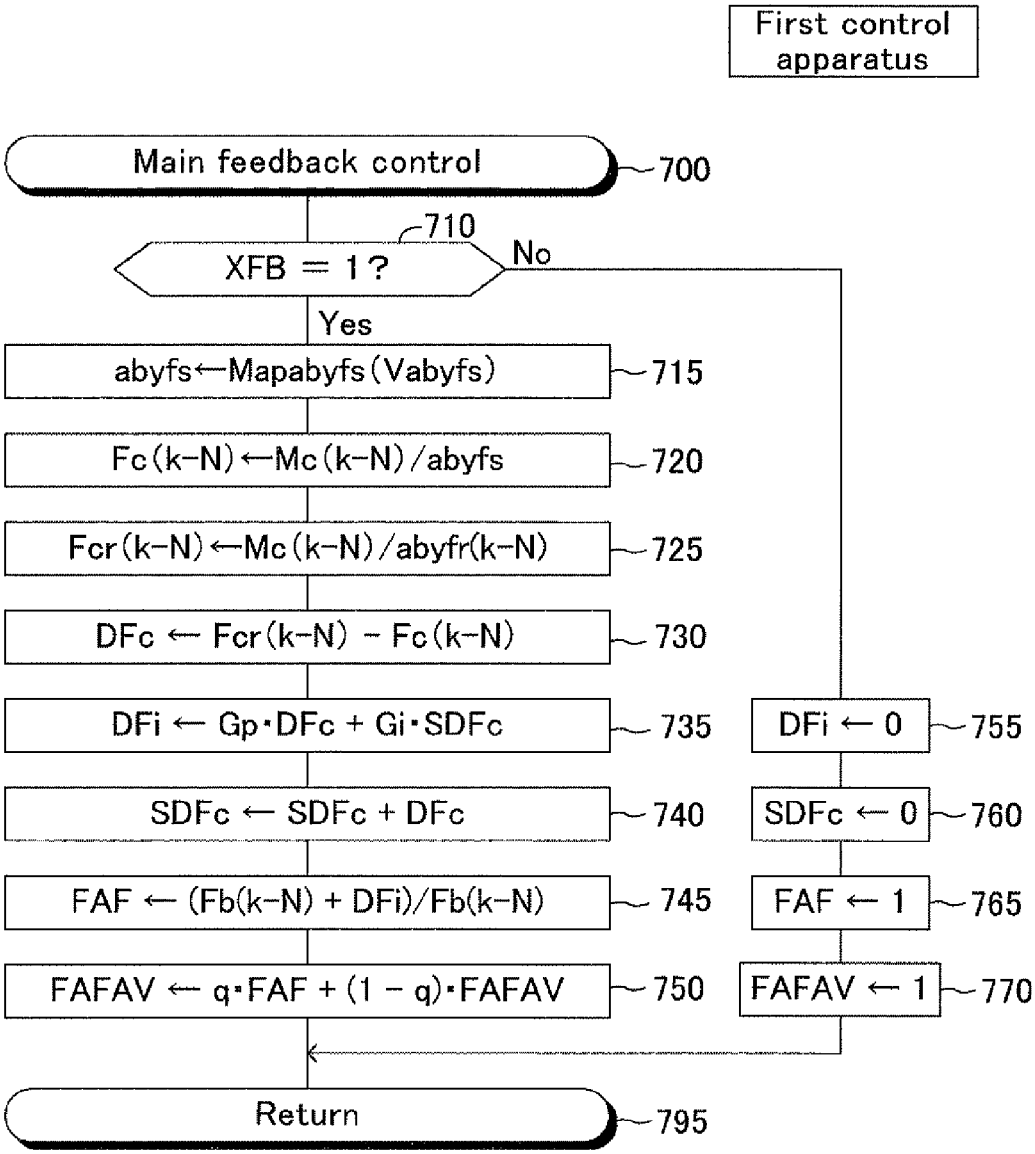
FIG. 7 is a flowchart showing a routine executed by the CPU of the first control apparatus.

The CPU repeatedly executes a "main feedback control routine" shown by a flowchart in FIG. 7, every time a predetermined time period elapses. Accordingly, at an appropriate point in time, the CPU starts the process from step 700 to proceed to step 710, at which the CPU determines whether or not the value of the feedback control flag XFB is "1."

The description continues assuming that the value of the feedback control flag XFB is "1." In this case, the CPU makes a "Yes" determination at step 710 to sequentially execute processes from step 715 to step 750 described below one after another, and then proceeds to step 795 to end the present routine tentatively.

Step 715: The CPU obtains the upstream air-fuel ratio abyfs by applying the output value Vabyfs of the upstream air-fuel ratio sensor 66 to the table Mapabyfs shown in FIG. 2.

Step 720: The CPU obtains an "in-cylinder fuel supply amount Fc(k−N)" which is an amount of the fuel actually supplied to the combustion chamber 21 for a cycle at a timing N cycles (i.e., N·720° crank angle) before the present time, through dividing the in-cylinder intake air amount Mc(k−N) which is the in-cylinder intake air amount for the cycle the N cycles before the present time by the upstream air-fuel ratio abyfs.

The reason why the cylinder intake air amount Mc(k−N) for the cycle N cycles before the present time is divided by the upstream air-fuel ratio abyfs in order to obtain the in-cylinder fuel supply amount Fc(k−N) is because the mixture burnt in the combustion chamber 21 requires time corresponding to the N cycles to reach the upstream air-fuel ratio sensor 66.

Step 725: The CPU obtains a "target in-cylinder fuel supply amount Fcr(k−N) for the cycle the N cycles before the present time" through dividing the "in-cylinder intake air amount Mc(k−N) for the cycle the N cycles before the present time" by the "target upstream air-fuel ratio abyfr for the cycle the N cycles before the present time."

Step 730: The CPU sets an error DFc of the in-cylinder fuel supply amount at a value obtained by subtracting the in-cylinder fuel supply amount Fc(k−N) from the target in-cylinder fuel supply amount Fcr(k−N). The error DFc of the in-cylinder fuel supply amount (=Fcr(k−N)−Fc(k−N)) represents excess and deficiency of the fuel supplied to the engine 10 for the cycle the N cycles before the present time.

Step 735: The CPU obtains a main feedback amount DFi according to a formula (4) described below. In the formula (4) below, Gp is a predetermined proportion gain, and Gi is a predetermined integration gain. Further, the value SDFc in the formula (4) is an integrated value of the error DFc of the in-cylinder fuel supply amount, and is obtained at step 740. That is, the first control apparatus calculates the main feedback amount DFi based on a proportional-integral control (PI control) to have the upstream air-fuel ratio abyfs coincide with the target upstream air-fuel ratio abyfr.

$$DFi=Gp\cdot DFc+Gi\cdot SDFc \tag{4}$$

Step 740: The CPU obtains a new integrated value SDFc of the error of the in-cylinder fuel supply amount by adding the error DFc of the in-cylinder fuel supply amount obtained at step 730 described above to the current/present integrated value SDFc of the error DFc of the in-cylinder fuel supply amount.

Step 745: The CPU calculates the main feedback coefficient FAF by applying the main feedback amount DFi and the base fuel injection amount Fb(k−N) to a formula (5) described below. That is, the main feedback coefficient FAF is obtained by dividing a "value obtained by adding the main feedback amount DFi to the base fuel injection amount Fb(k−N) for the cycle the N cycles before the present time" by the "base fuel injection amount Fb(k−N)."

$$FAF=(FB(k-N)+DFi)/Fb(k-N) \quad (5)$$

Step 750: The CPU calculates a weighted average of the main feedback coefficient FAF as a main feedback coefficient FAFAV (hereinafter, referred to as a "correction coefficient average FAFAV") according to a formula (6) described below. In the formula (6), FAFAVnew is an updated correction coefficient average FAFAV, which is stored as a new correction coefficient average FAFAV. In the formula (6), the value q is a constant which is larger than 0 and smaller than 1. As described later, the correction coefficient average FAFAV is used to obtain the main FB learning value and the evaporated fuel gas concentration learning value FGPG.

$$FAFAVnew=q\cdot FAF+(1-q)\cdot FAFAV \quad (6)$$

In this manner, the main feedback amount DFi is obtained according to the proportional-integral control, and the main feedback amount DFi is converted into the main feedback coefficient FAF. The main feedback coefficient FAF is reflected on the instructed fuel injection amount Fi at step 560 in FIG. 5 described above. As a result, the excess and deficiency of the fuel supplied to the engine is compensated, and therefore, an average of the air-fuel ratio of the engine (thus, the air-fuel ratio of the gas flowing into the upstream catalyst 43) is made to approximately coincide with the target upstream air-fuel ratio abyfr.

To the contrary, if the value of the feedback control flag XFB is "0" on the determination of step 710, the CPU makes a "No" determination at step 710 to sequentially execute processes from step 755 to step 770 described below, and thereafter proceeds to step 795 to end the present routine tentatively.

Step 755: The CPU sets the value of the main feedback amount DFi to "0."

Step 760: The CPU sets the value of the integrated value SDFc of the error of the in-cylinder fuel supply amount to "0."

Step 765: The CPU sets the value of the main feedback coefficient FAF to "1."

Step 770: The CPU sets the value of the correction coefficient average FAFAV to "1."

In this manner, when the value of the feedback control flag XFB is "0" (when the feedback control condition is not satisfied), the value of the main feedback amount DFi is set to "0", and the value of the main feedback coefficient FAF is set to "1." Accordingly, the correction on the base fuel injection amount Fb(k) by the main feedback coefficient FAF is not carried out. Note that, even in this case, the base fuel injection amount Fb(k) is corrected by the main FB learning value KG.

<Main Feedback Learning (Base Air-Fuel Ratio Learning)>

The first control apparatus updates the main FB learning value KG based on the correction coefficient average FAFAV in such a manner that the main feedback coefficient FAF is made to come closer to a base value "1" in a period in which the instruction signal to maintain a state in which the purge control valve 55 is fully closed is being sending to the purge control valve 55 (a purge control valve closing instruction period, a period in which the duty ratio DPG is "0").

Figure 8:
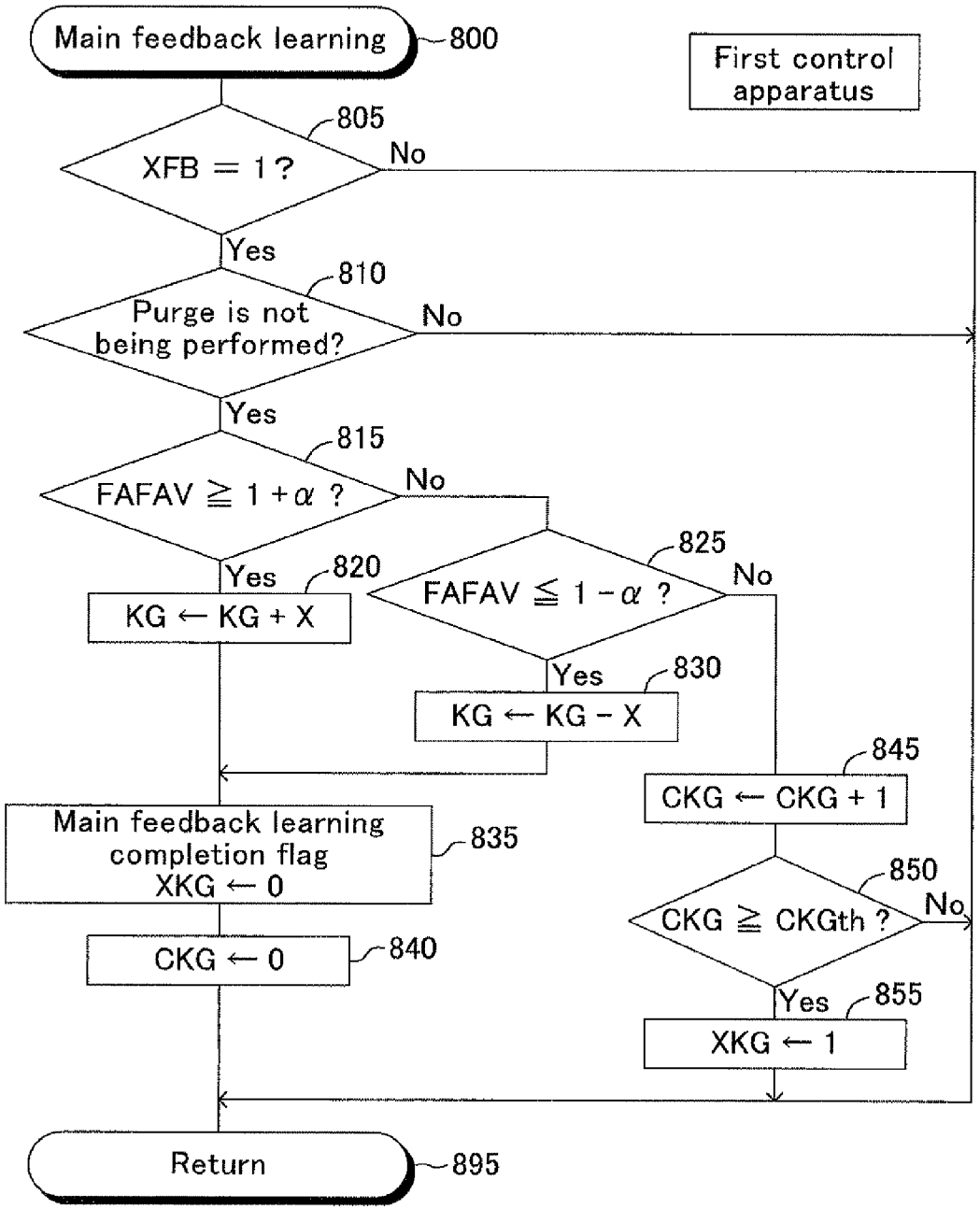
FIG. 8 is a flowchart showing a routine executed by the CPU of the first control apparatus.

In order to update the main FB learning value KG, the CPU repeatedly executes the main feedback learning routine shown in FIG. 8, every time a predetermined time period elapses. Accordingly, at an appropriate point in time, the CPU starts the process from step 800 to proceed to step 805, at which the CPU determines whether or not the value of the feedback control flag XFB is "1."

If the value of the feedback control flag XFB is not "1" at this point in time (i.e., when the main feedback control is not being carried out), the CPU makes a "No" determination at step 805 to proceed to step 895, at which the CPU ends the present routine tentatively. Consequently, the update of the main FB learning value is not carried out.

In contrast, when the value of the feedback control flag XFB is "1" (when the feedback control is being carried out), the CPU makes a "Yes" determination at step 805 to proceed to 810, at which the CPU determines whether or not the evaporate fuel purge is not being carried out. More specifically, the CPU determines whether the "duty ratio DPG determined in the routine shown in FIG. 9 described later" is "0." When the evaporate fuel purge is being carried out (the duty ratio DPG is not "0"), the CPU makes a "No" determination at step 810 to directly proceed to step 895, at which the CPU ends the present routine tentatively. As a result, the update of the main FB learning value KG is not carried out.

On the other hand, if the evaporate fuel purge is not being carried out (the duty ratio DPG is "0") when the CPU executes the process of step 810, the CPU makes a "Yes" determination at step 810 to proceed to step 815, at which the CPU determines whether the value of the correction coefficient average FAFAV is equal to or larger than a value 1+α. The value α is a predetermined value larger than 0 and smaller than 1, and is, for example, 0.02. When the value of the correction coefficient average FAFAV is equal to or larger than the value 1+α, the CPU proceeds to step 820 to increase the main FB learning value KG by a positive predetermined value X. Thereafter, the CPU proceeds to step 835.

In contrast, if the value of the correction coefficient average FAFAV is smaller than the value 1+α when the CPU executes the process of step 815, the CPU proceeds to step 825 to determine whether or not the value of the correction coefficient average FAFAV is equal to or smaller than a value 1−α. When the value of the correction coefficient average FAFAV is equal to or smaller than the value 1−α, the CPU proceeds to step 830 to decrease the main FB learning value KG by the positive predetermined value X. Thereafter, the CPU proceeds to step 835.

Further, when the CPU proceeds to step 835, the CPU sets a value of a main feedback learning completion flag (main FB learning completion flag) XKG to "0" at step 835. The main FB learning completion flag XKG indicates that the main feedback learning has completed when the value of the main FB learning completion flag XKG is "1", and that the main feedback learning has not yet completed when the value of the main FB learning completion flag XKG is "0."

Subsequently, the CPU proceeds to step 840 to set a value of a main learning counter CKG to "0." It should be noted that the value of the main learning counter CKG is also set to "0" in an initial routine executed when an unillustrated ignition key switch of a vehicle on which the engine 10 is mounted changed from an off-position to an on-position. Thereafter, the CPU proceeds to step 895 to end the present routine tentatively.

If the value of the correction coefficient average FAFAV is larger than the value 1−α (i.e., the value of the correction coefficient average FAFAV is between the value 1+α and the value 1−α) when the CPU executes the process of step 825, the CPU proceeds to step 845 to increase the value of the main learning counter CKG by "1."

Subsequently, the CPU proceeds to step 850 to determine whether or not the value of the main learning counter CKG is equal to or larger than a predetermined main learning counter threshold CKGth. When the value of the main learning counter CKG is equal to or larger than the predetermined main learning counter threshold CKGth, the CPU makes a "Yes" determination at step 850 to proceed to step 855, at which the CPU sets the value of the main FB learning completion flag XKG to "1."

That is, when the number (i.e. time duration) of times of a state in which the correction coefficient average FAFAV is between the value $1-\alpha$ and the value $1+\alpha$ after the start of the engine 10 becomes equal to or larger than the main learning counter threshold CKGth, it is assumed that the learning of the main FB learning value KG has completed. Thereafter, the CPU proceeds to step 895 to end the present routine tentatively.

In contrast, if the value of the main learning counter CKG is smaller than the predetermined main learning counter threshold CKGth when the CPU executes the process of step 850, the CPU makes a "No" determination at step 850 to directly proceed from step 850 to step 895 so that the CPU ends the present routine tentatively.

With the operations described above, the main FB learning value KG is updated when the main feedback control is being performed and the evaporated fuel purge is not being performed.

<Driving of the Purge Control Valve>

Figure 9:
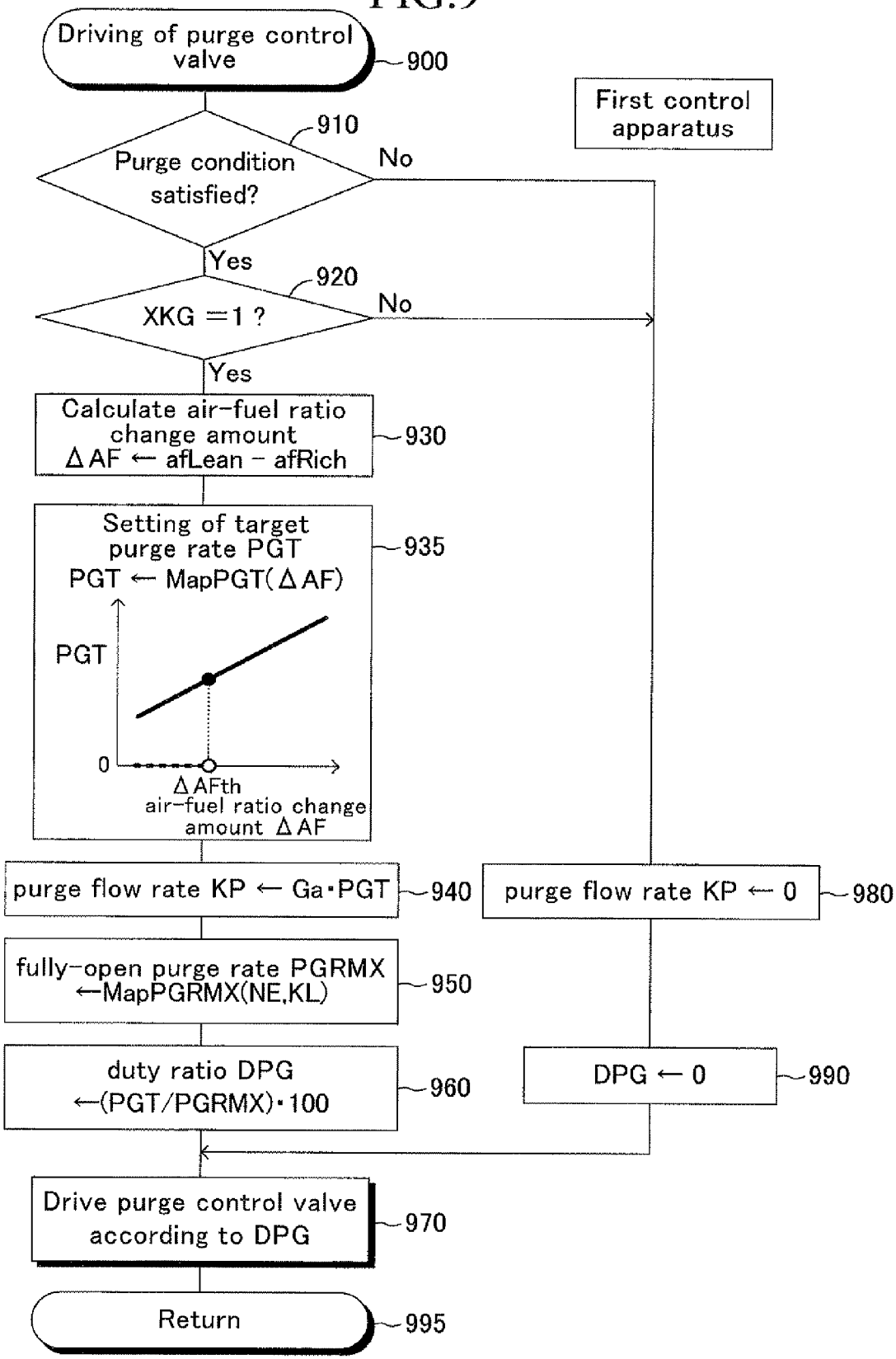
FIG. 9 is a flowchart showing a routine executed by the CPU of the first control apparatus.

Meanwhile, the CPU executes the purge control valve driving routine shown in FIG. 9, every time a predetermined time period elapses. Accordingly, at an appropriate point in time, the CPU starts the process from step 900 to proceed to step 910, at which the CPU determines whether or not the purge condition is satisfied. The purge condition is satisfied when all of conditions described below are satisfied, for example.

(B1) The value of the feedback control flag XFB is "1" (the main feedback control is being performed).

(B2) The engine 10 is being stably operated (for example, a change amount per unit time of the throttle valve opening TA representing a load of the engine is equal to or smaller than a predetermined value).

It is assumed here that the purge condition is satisfied. In this case, the CPU makes a "Yes" determination at step 910 to proceed to step 920, at which the CPU determines whether or not the value of the main FB learning completion flag XKG is "1" (that is, whether or not the main feedback control has competed). When the value of the main FB learning completion flag XKG is "1", the CPU makes a "Yes" determination at step 920 to sequentially execute processes from step 930 to step 970 described below, and thereafter proceeds to step 995 to end the present routine tentatively.

Step 930: The CPU obtains a magnitude of an air-fuel ratio change amount ΔAF by subtracting the target rich air-fuel ratio afRich from the target lean air-fuel ratio afLean. That is, the magnitude of the air-fuel ratio change amount ΔAF is equal to a magnitude |afLean−afRich| of a difference between the target lean air-fuel ratio afLean and the target rich air-fuel ratio afRich.

Step 935: The CPU determines the target purge rate PGT based on the magnitude of the air-fuel ratio change amount ΔAF. The target purge rate PGT is set so as to become larger as the magnitude of the air-fuel ratio change amount ΔAF becomes larger. It should be noted that the purge rate is a ratio of a purge flow rate KP to the intake air amount Ga (purge rate=KP/Ga). That is, the purge flow rate KP represents a flow rate of the evaporated fuel gas introduced into the engine (introduced into the intake passage), and is also referred to as an evaporated fuel gas purge amount KP. The purge rate may be expressed as a ratio (purge rate=KP/(Ga+KP)) of the evaporated fuel gas purge amount KP to a "sum (Ga+KP) of the intake air amount Ga and the evaporated fuel gas purge amount KP."

Step 940: The CPU calculates a product of the target purge rate PGT and the intake air amount (flow rate) Ga as the purge amount (flow rate) KP.

Step 950: The CPU obtains fully-open purge rate PGRMX by applying the engine rotational speed NE and the load KL to a map MapPGRMX. The fully-open purge rate PGRMX is the purge rate when the purge control valve 55 is fully opened. The map MapPGRMX is obtained in advance based on results of an experiment or a simulation, and is stored in the ROM. According to the map MapPGRMX, the fully-open purge rate PGRMX becomes smaller, as the engine rotational speed NE becomes higher or as the load KL becomes higher.

Step 960: The CPU calculates the duty ratio DPG (%) by multiplying 100 by a value obtained by dividing the target purge rate PGT by the fully-open purge rate PGRMX.

Step 970: The CPU opens/closes the purge control valve 55 based on the duty ratio DPG.

In contrast, when the purge condition is not satisfied, the CPU makes a "No" determination at step 910 to proceed to step 980, at which the CPU sets the purge flow rate KP to "0." Subsequently, the CPU sets the duty ratio DPG to "0" at step 990, and proceeds to step 970. In this case, the duty ratio DPG is set at "0", and thus, the purge control valve 55 is fully/completely closed. Thereafter, the CPU proceeds to step 995 to end the present routine tentatively.

Further, if the value of the main FB learning completion flag XKG is "0" when the CPU executes the process of step 920, the CPU makes a "No" determination at step 920 to execute processes of step 980, step 990, and step 970. In this case as well, since the duty ratio is set at "0", the purge control valve 55 is fully/completely closed. Thereafter, the CPU proceeds to step 995 to end the present routine tentatively.

<Evaporated Fuel Gas Concentration Learning>

Figure 10:
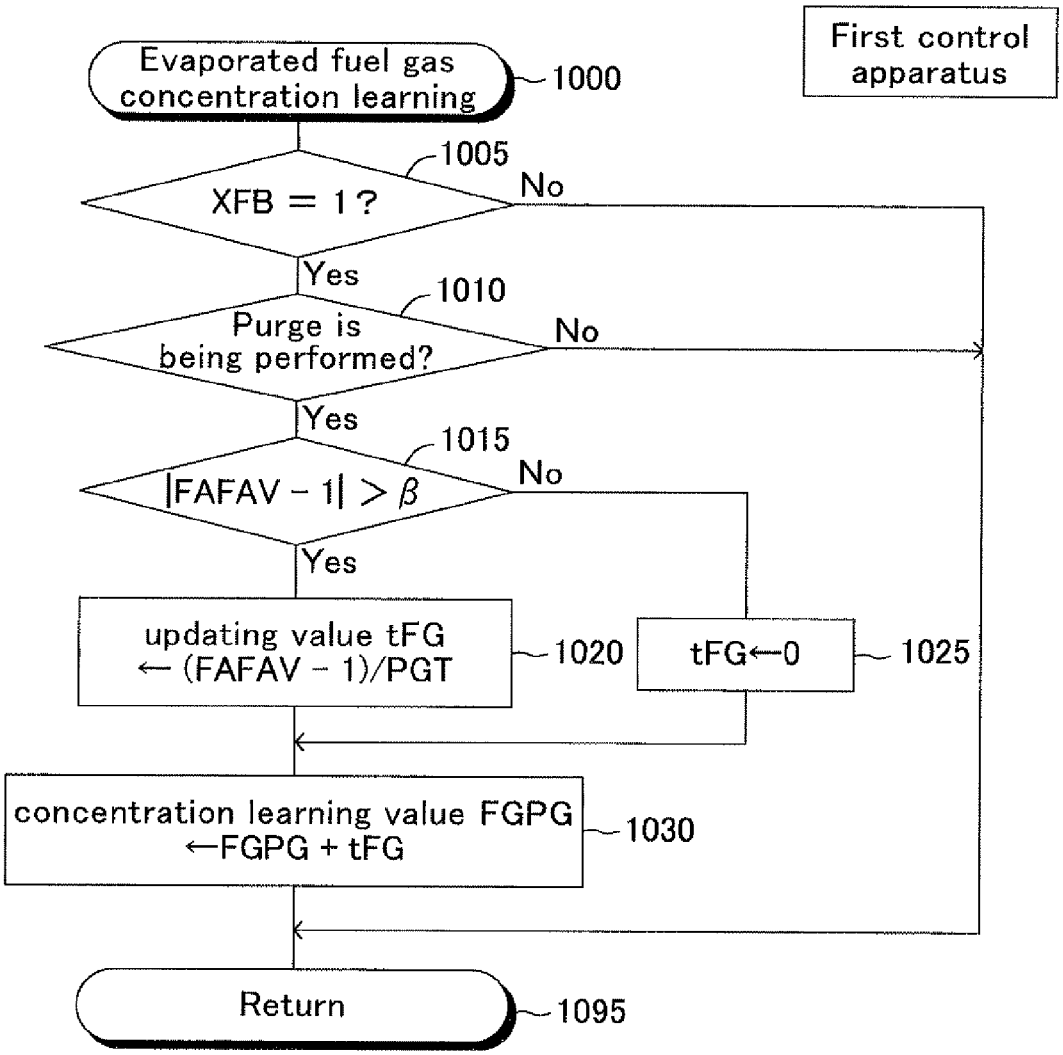
FIG. 10 is a flowchart showing a routine executed by the CPU of the first control apparatus.

Further, the CPU executes the evaporated fuel gas concentration learning routine shown in FIG. 10, every time a predetermined time period elapses. By the evaporated fuel gas concentration learning routine, the evaporated fuel gas concentration learning value FGPG is updated.

At an appropriate point in time, the CPU starts the process from step 1000 to proceed to step 1005, at which the CPU determines whether or not the value of the feedback control flag XFB is "1" (whether or not the main feedback control is being performed). When the value of the feedback control flag XFB is "0", the CPU makes a "No" determination at step 1005 to directly proceed to step 1095, at which the CPU ends the present routine tentatively. Consequently, the evaporated fuel gas concentration learning value FGPG is not updated.

On the other hand, when the value of the feedback control flag XFB is "1", the CPU makes a "Yes" determination at step 1005 to proceed to step 1010, at which the CPU determines whether or not the evaporated fuel purge is being performed (specifically, whether or not the duty ratio DPG obtained by the routine shown in FIG. 9 is not "0"). When the evaporated fuel purge is not being performed, the CPU makes a "No" determination at step 1010 to directly proceed to step 1095 to end the present routine tentatively. Consequently, the evaporated fuel gas concentration learning value FGPG is not updated.

In contrast, if the evaporated fuel purge is being performed when the CPU proceeds to step 1010, the CPU makes a "Yes" determination at step 1010 to proceed to step 1015, at which the CPU determines whether or not a value |FAFAV−1| which is an absolute value of a value obtained by subtracting "1" from the correction coefficient average FAFAV is equal to or larger than a predetermined value β. The value β is the predetermined minute value larger than 0 and smaller than 1, and is, for example, 0.02.

When the absolute value |FAFAV−1| is equal to or larger than the predetermined value β, the CPU makes a "Yes" determination at step 1015 to proceed to step 1020, at which the CPU obtains an updating value tFG according to a formula (7) described below. The target purge rate PGT in the formula (7) is set at step 935 shown in FIG. 9. As is understood from the formula (7), the updating value tFG is equal to a "correction amount (deviation) εa (=FAFAV−1)" per 1% of the target purge rate PGT. Thereafter, the CPU proceeds to step 1030.

$$tFG=(FAFAV-1)/PGT \quad (7)$$

When the evaporated fuel purge is being performed, the upstream air-fuel ratio abyfs becomes smaller in a rage smaller than the stoichiometric air-fuel ratio (richer than the stoichiometric air-fuel ratio) as the evaporated fuel gas concentration becomes higher. Accordingly, the main feedback coefficient FAF becomes smaller, and thus, the correction coefficient average FAFAV becomes smaller than "1." Consequently, the value FAFAV−1 becomes negative, and thus, the updating value tFG becomes negative. Further, an absolute value of the updating value tFG becomes larger as the value FAFAV becomes smaller (deviates more from "1"). Accordingly, the updating value tFG becomes a negative value whose absolute value becomes larger, as the evaporated fuel gas concentration becomes higher.

In contrast, when the absolute value |FAFAV−1| is equal to or smaller than the predetermined value β, the CPU makes a "No" determination at step 1015 to proceed to step 1025, at which the CPU sets the updating value tFG to "0." Thereafter, the CPU proceeds to step 1030.

At step 1030, the CPU updates the evaporated fuel gas concentration learning value FGPG according to a formula (8) described below, and then proceeds to step 1095 to end the present routine tentatively. In the formula (8), the value FGPGnew is the updated evaporated fuel gas concentration learning value FGPG. As a result, the evaporated fuel gas concentration learning value FGPG becomes smaller as the evaporated fuel gas concentration becomes higher. It should be noted that an initial value of the evaporated fuel gas concentration learning value FGPG is set at "1."

$$FGPGnew=FGPG+tFG \quad (8)$$

The purge of the evaporated fuel is carried out after the main feedback learning has completed (when the value of the main FB learning completion flag XKG is "1") (refer to step 920 shown in FIG. 9). Further, the instructed fuel injection amount Fi is corrected by the purge correction coefficient FPG as shown in the formula (3) described above. In addition, as shown in the formula (2) described above, the purge correction coefficient FPG is calculated based on the evaporated fuel gas concentration learning value FGPG. Accordingly, a value indicating a degree of a deviation of the main feedback coefficient FAF during the purge from "1" (that is, the absolute value |FAFAV−1|) represents a degree of a deviation of the evaporated fuel gas concentration learning value FGPG from a true (proper) value. In view of the above, as described above, the evaporated fuel gas concentration learning value FGPG is renewed when the absolute value |FAFAV−1| is larger than the predetermined value β.

<Air-Fuel Ratio Request (Catalyst State) Determination>

Figure 11:
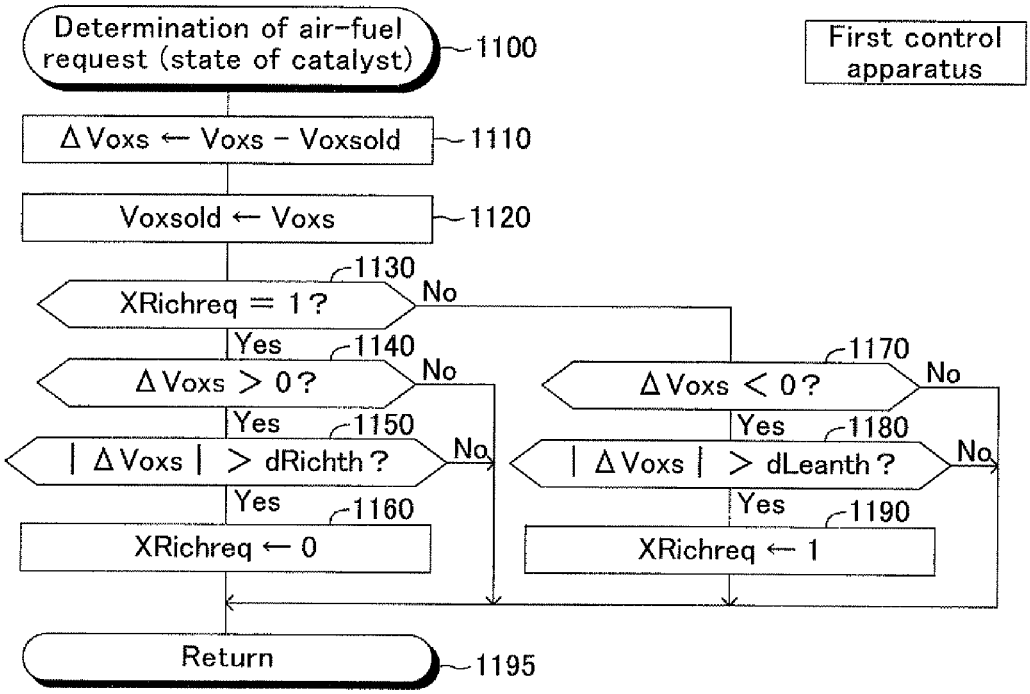
FIG. 11 is a flowchart showing a routine executed by the CPU of the first control apparatus.

The CPU executes the air-fuel ratio request (catalyst state) determining routine shown in FIG. 11, every time a predetermined time is period elapses. Therefore, at an appropriate point in time, the CPU starts the process from step 1100 to proceed to step 1110, at which the CPU calculates a change amount ΔVoxs of the output value Voxs per a predetermined time (unit time) ts by subtracting a "previous output value Voxsold of the downstream air-fuel ratio sensor 67" from a "current output value Voxs of the downstream air-fuel ratio sensor 67." The previous output value Voxsold is a value updated at next step 1120, and is the output Voxs at a point in time the predetermined time ts before the present point in time (output value Voxs when the present routine was previously executed). Subsequently, the CPU proceeds to step 1120 to store the output value Voxs at the present point in time as the "previous output value Voxsold."

Subsequently, the CPU proceeds to step 1130 to determine whether or not the value of the rich request flag XRichreq is "1." The value of the rich request flag XRichreq is set at "1" in the initial routine described above. Further, as described later, the value of the rich request flag XRichreq is set to "0" when it is determined that the state of the catalyst 43 is the oxygen shortage state (rich state) based on the output value Voxs of the downstream air-fuel ratio sensor 67, and is set to "1" when it is determined that the state of the catalyst 43 is the oxygen excess state (lean state) based on the output value Voxs of the downstream air-fuel ratio sensor 67.

It is now assumed that the value of the rich request flag XRichreq is "1." In this case, the CPU makes a "Yes" determination at step 1130 to proceed to step 1140, at which the CPU determines whether or not the change speed ΔVoxs is positive. That is, the CPU determines whether or not the output value Voxs is increasing. When the change speed ΔVoxs is not positive, the CPU makes a "No" determination at step 1140 to directly proceed to step 1195, at which the CPU ends the present routine tentatively.

In contrast, when the change speed ΔVoxs is positive, the CPU makes a "Yes" determination at step 1140 to proceed to step 1150, at which the CPU determines whether a magnitude |ΔVoxs| of the change speed ΔVoxs is larger than the rich determining threshold dRichth. When the magnitude |ΔVoxs| is equal to or smaller than the rich determining threshold dRichth, the CPU makes a "No" determination at step 1150 to directly proceed to step 1195, at which the CPU ends the present routine tentatively.

To the contrary, when the magnitude |ΔVoxs| of the change speed ΔVoxs is larger than the rich determining threshold dRichth, the CPU makes a "Yes" determination at step 1150 to proceed to step 1160, at which the CPU sets the value of the rich request flag XRichreq to "0." That is, when the output value Voxs is increasing and the magnitude of the change speed ΔVoxs is larger than the rich determining threshold dRichth, the CPU determines that the "state of the catalyst 43 is the oxygen shortage state", and sets the value of the rich request flag XRichreq to "0."

When the CPU again starts the process from step 1110 in this state (that is, in the state in which the value of the rich request flag XRichreq is set at "0"), the CPU proceeds to step 1130 via step 1110 and step 1120, and makes a "No" determination at step 1130 to proceed to step 1170.

The CPU determines whether the change speed ΔVoxs is negative at step 1170. That is, the CPU determines whether or not the output value Voxs is decreasing. When the output value Voxs is not decreasing, the CPU makes a "No" determination at step 1170 to directly proceed to step 1195 to end the present routine tentatively.

In contrast, when the change speed ΔVoxs is negative, the CPU makes a "Yes" determination at step 1170 to proceed to step 1180, at which the CPU determines whether or not the magnitude |ΔVoxs| of the change speed ΔVoxs is larger than the lean determining threshold dLeanth. When the magnitude |ΔVoxs| is equal to or smaller than the lean determining threshold dLeanth, the CPU makes a "No" determination at step 1180 to directly proceed to step 1195, at which the CPU ends the present routine tentatively.

To the contrary, when the magnitude |ΔVoxs| of the change speed ΔVoxs is larger than the lean determining threshold dLeanth, the CPU makes a "Yes" determination at step 1180 to proceed to step 1190, at which the CPU sets the value of the rich request flag XRichreq to "1." That is, when the output value Voxs is decreasing and the magnitude of the change speed ΔVoxs is larger than the lean determining threshold dLeanth, the CPU determines that the "state of the catalyst 43 is the oxygen excess state", and sets the value of the rich request flag XRichreq to "1."

It should be noted that the CPU may set the value of the rich request flag XRichreq to "0", when the output value Voxs becomes larger than a rich determining threshold VRichth while the value of the rich request flag XRichreq to "1." Similarly, the CPU may set the value of the rich request flag XRichreq to "1", when the output value Voxs becomes smaller than a lean determining threshold VLeanth while the value of the rich request flag XRichreq to "0." In those cases, the rich determining threshold VRichth may be a value equal to or smaller than the middle value Vmid, and the lean determining threshold VLeanth may be a value equal to or larger than the middle value Vmid.

In this manner, the value of the rich request flag XRichreq is set to either "1" or "0" alternately based on the output value Voxs of the downstream air-fuel ratio sensor 67. Further, the target upstream air-fuel ratio abyfr is determined in accordance with the value of the rich request flag XRichreq (refer to the routine shown in FIG. 6), and the instructed fuel injection amount Fi is determined based on the target upstream air-fuel ratio abyfr (refer to the routine shown in FIG. 5).

As described above, the first control apparatus comprises:

a target air-fuel ratio setting section (refer to the routine shown in FIG. 11) configured so as to set, based on the output value Voxs of the downstream air-fuel ratio sensor 67, the target upstream air-fuel ratio abyfr which is the target value of the air-fuel ratio of the gas flowing into the catalyst 43 to "the target rich air-fuel ratio and the target lean air-fuel ratio" alternately;

the fuel injection valve(s) 33 configured so as to inject the fuel to the engine 10;

the fuel injection control section (refer to steps from step 530 to step 570 shown in FIG. 5) configured so as to determine the fuel injection amount (instructed fuel injection amount Fi) which is an amount of the fuel to be injected from the fuel injection valve 33 in accordance with (based on) the target upstream air-fuel ratio abyfr, and so as to have the fuel injection valve 33 inject the fuel of the determined fuel injection amount from the fuel injection valve 33;

the evaporated fuel purge section configured so as to introduce the evaporated fuel generated in the fuel tank 51 for storing the fuel supplied to the fuel injection valve 33 into the intake passage of the engine 10 (refer to the canister 52, the vapor collecting pipe 53, the purge flowing passage pipe 54, the purge control valve 55, and the like); and the evaporated fuel purge amount control section (refer to the routine shown in FIG. 9) configured so as to control the purge amount (the target purge rate PGT or the purge flow rate KP, and thus, the duty ratio DPG) which is an amount of the evaporated fuel introduced into the intake passage by the evaporated fuel purge section.

Further, in the first control apparatus, the target air-fuel ratio setting section is configured:

so as to set the target rich air-fuel ratio afRich to the "first target rich air-fuel ratio afRich1 smaller than the stoichiometric air-fuel ratio" and set the target lean air-fuel ratio afLean to the "first target lean air-fuel ratio afLean1 larger than the stoichiometric air-fuel ratio", when the operating state indicating value (intake air amount Ga) indicative of the operating state of the engine 10 is equal to the first value (Ga1); and so as to set the target rich air-fuel ratio afRich to the "second target rich air-fuel ratio afRich2 smaller than the first target rich air-fuel ratio afRich 1" and set the target lean air-fuel ratio afLean to the "second target lean air-fuel ratio afLean2 larger than the first target lean air-fuel ratio afLean1", when the operating state indicating value (intake air amount Ga) is equal to the "second value (Ga2) different from the first value (Ga1)" (refer to step 640 and step 650 shown in FIG. 6); and the evaporated fuel purge amount control section is configured so as to increase the purge amount as the magnitude (=air-fuel ratio change amount ΔAF=|afLean−afRich|) of the difference between the target lean air-fuel ratio afLean and the target rich air-fuel ratio afRich becomes larger (refer to step 930, step 935, and steps from step 940 to step 970, shown in FIG. 9).

In the first control apparatus, the target rich air-fuel ratio afRich becomes smaller and the target lean air-fuel ratio afLean becomes larger, as the air-fuel ratio change amount ΔAF becomes larger. Accordingly, for example, even if the air-fuel ratio of the catalyst inflow gas greatly fluctuates due to the large deviation of the value of the evaporated fuel gas concentration learning value FGPG from the proper value when the evaporated fuel is started, the air-fuel ratio of the catalyst inflow gas changes to a value which can promptly absorb/compensate the deviation when the influence of the fluctuation of the air-fuel ratio of the catalyst inflow gas emerges on the output value Voxs of the downstream air-fuel ratio sensor. Consequently, a time period in which the oxygen storage amount of the catalyst 43 is maintained at the "maximum oxygen storage amount Cmax" or "0" (that is, a time duration in which the emission worsens) can be made shorter.

In contrast, when the air-fuel ratio change amount ΔAF is small, the amount of the evaporated fuel which is purged becomes small. Accordingly, the degree that the air-fuel ratio is disturbed when the purge is started can be suppressed. As a result, even when the air-fuel ratio change amount ΔAF is small, it is possible to avoid that the time period in which the oxygen storage amount of the catalyst 43 is maintained at the "maximum oxygen storage amount Cmax" or "0" becomes long. Thus, the first control apparatus can carry out the purge of the evaporated fuel while maintaining the "possibility that the emission worsens" at a low level.

From a different point of view, the maximum oxygen storage amount Cmax of the catalyst 43 when the air-fuel ratio change amount ΔAF is large becomes larger than that of the catalyst 43 when the air-fuel ratio change amount ΔAF is small. In other words, the catalyst 43 can store and release a greater amount of oxygen when the larger target lean air-fuel ratio afLean and the smaller target rich air-fuel ratio afRich are alternately set. Therefore, the purge can promptly be carried out while avoiding the worsening of the emission, by increasing the purge amount in such a case.

It should be noted that, as shown by a broken line in a block of step 935 in FIG. 9, the first control apparatus may terminate (prohibit) the evaporated fuel purge by setting the target purge rate PGT to "0" when the air-fuel ratio change amount ΔAF is smaller than an air-fuel ratio change amount threshold ΔAFth.

Further, in the first control apparatus, the operating state indicating value for determining the target rich air-fuel ratio afRich and the target lean air-fuel ratio afLean is the intake air amount Ga, however, the operating state indicating value may be one or more of parameters indicative of the operating state of the engine 10, such as the throttle valve opening TA, the load KL of the engine 10, the engine rotational speed NE, the cooling water temperature THW, the evaporated fuel gas concentration learning value FGPG, and the like. Furthermore, as shown in step 640 and step 650, the target rich air-fuel ratio afRich and the target lean air-fuel ratio afLean may be values continuously varying depending on the operating state indicating value, or may be values which discretely varies (in a stepwise fashion) with respect to the operating state indicating value.

Second Embodiment

Next, there will be described a control apparatus for an internal combustion engine according to a second embodiment of the present invention (hereinafter, simply referred to as a "second control apparatus").

The canister 52 retains the adsorbent material, and therefore, there is an upper limit on an amount of the evaporated fuel which the canister can adsorb. This upper limit is also referred to as a canister saturated evaporated fuel amount. Since the evaporated fuel gas concentration becomes higher as an "amount of the evaporated fuel adsorbed in the canister 52" comes closer to the canister saturated evaporated fuel amount, the evaporated fuel gas concentration learning value FGPG becomes smaller. In view of the above, the second control apparatus obtains, as a value indicative of an "amount of the evaporated fuel adsorbed in the canister 52", that is, an estimated adsorbed amount of the evaporated fuel, a value (1-FGPG) obtained by subtracting the evaporated fuel gas concentration learning value FGPG from "1."

Thereafter, the second control apparatus makes the target rich air-fuel ratio afRich smaller and makes the target lean air-fuel ratio afLean larger, when a difference between the estimated adsorbed amount of the evaporated fuel and the canister saturated evaporated fuel amount becomes equal to or smaller than a predetermined amount (i.e., when the canister becomes in a canister saturated state), as compared with a case in which the difference between the estimated adsorbed amount of the evaporated fuel and the canister saturated evaporated fuel amount is larger than the predetermined amount. Accordingly, the difference between the target lean air-fuel ratio afLean and the target rich air-fuel ratio afRich (air-fuel ratio change amount ΔAF=|afLean−afRich|) becomes larger in such a case, and thus, the target purge rate PGT (and thus, the purge flow rate KP) can be increased. Consequently, an amount of the evaporated fuel which the canister 52 can further adsorb can promptly be restored to a certain degree.

(Actual Operation)

An actual operation of the second control apparatus will next be described. A CPU of the second control apparatus executes the routines which the CPU of the first control apparatus executes except the routine shown in FIG. 6. Further, the CPU of the second control apparatus executes a "target air-fuel ratio determining routine shown by a flowchart in FIG. 12 in place of FIG. 6", every time a predetermined time period elapses. Accordingly, the operation of the second control apparatus will be described mainly referring to FIG. 12, hereinafter.

Figure 12:
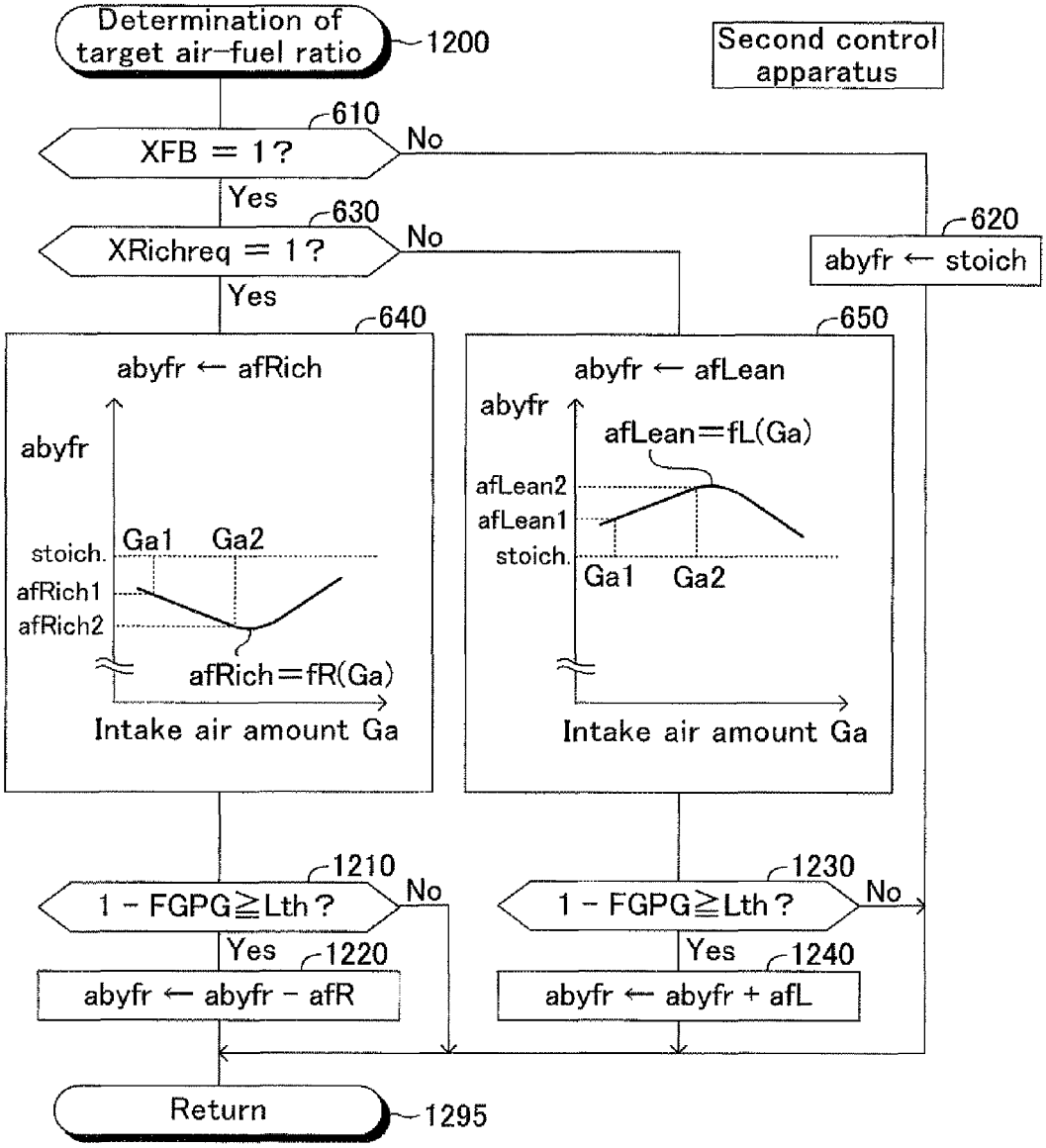
FIG. 12 is a flowchart showing a routine executed by a CPU of a control apparatus (second control apparatus) according to a second embodiment of the present invention.

The routine shown in FIG. 12 is similar to the routine shown in FIG. 6. Each step in FIG. 12 at which the same process is performed as each step in FIG. 6 is given the same numeral as one given to such step in FIG. 6. A detail description on such a step will be appropriately omitted. The routine shown in FIG. 12 is a routine in which "step 1210 and step 1220" are added after step 640 shown in FIG. 6, and further, "step 1230 and step 1240" are added after step 650 shown in FIG. 6.

More specifically, when the value of the rich request flag XRichreq is "1", the CPU determines the target rich air-fuel ratio afRich based on the operating state indicating value of the engine 10 (intake air amount Ga) at step 640, and thereafter, proceeds to step 1210 to determine whether or not the value (1−FGPG) is equal to or larger than a threshold value Lth. That is, the CPU determines whether or not the "difference between the estimated adsorbed amount of the evaporated fuel indicated by the evaporated fuel gas concentration learning value FGPG and the canister saturated evaporated fuel amount" is equal to or smaller than a predetermined amount.

When the estimated adsorbed amount of the evaporated fuel (1−FGPG) is larger than the threshold Lth (i.e., when the "difference between the estimated adsorbed amount of the evaporated fuel and the canister saturated evaporated fuel amount" is equal to or smaller than the predetermined amount), the CPU makes a "Yes" determination at step 1210 to proceed to step 1220 to again set a value (=afRich−afR) obtained by subtracting a predetermined air-fuel ratio afR from the target rich air-fuel ratio afRich into a renewed target rich air-fuel ratio afRich. Thereafter, the CPU proceeds to step 1295. It should be noted that, in the second control apparatus, the target rich air-fuel ratio afRich before it is reset at step 1220 is also referred to as a first target rich air-fuel ratio afRich1, and the target rich air-fuel ratio afRich after it is reset at step 1220 is also referred to as a second target rich air-fuel ratio afRich2, for convenience. In contrast, when the estimated adsorbed amount of the evaporated fuel (1−FGPG) is smaller than the threshold Lth, the CPU makes a "No" determination at step 1210 to directly proceed to step 1295, at which the CPU ends the present routine tentatively.

Similarly, when the value of the rich request flag XRichreq is "0", the CPU determines the target lean air-fuel ratio afLean at step 650, and thereafter, proceeds to step 1230 to determine whether or not the estimated adsorbed amount of the evaporated fuel (1−FGPG) is equal to or larger than the threshold value Lth. That is, the CPU determines whether or not the "difference between the estimated adsorbed amount of the evaporated fuel (1−FGPG) indicated by the evaporated fuel gas concentration learning value FGPG and the canister saturated evaporated fuel amount" is equal to or smaller than the predetermined amount.

When the estimated adsorbed amount of the evaporated fuel (1−FGPG) is larger than the threshold Lth, the CPU makes a "Yes" determination at step 1230 to proceed to step 1240 to again set a value (=afLean+afL) obtained by adding a predetermined air-fuel ratio afL to the target lean air-fuel ratio afLean into a renewed target lean air-fuel ratio afLean. Thereafter, the CPU proceeds to step 1295. It should be noted that, in the second control apparatus, the target lean air-fuel ratio afLean before it is reset at step 1240 is also referred to as a first target lean air-fuel ratio afLean1, and the target lean air-fuel ratio afLean after it is reset at step 1240 is also referred to as a second target lean air-fuel ratio afLean2, for convenience. In contrast, when the estimated adsorbed amount of the evaporated fuel (1−FGPG) is smaller than the threshold Lth, the CPU makes a "No" determination at step 1230 to directly proceed to step 1295, at which the CPU ends the present routine tentatively.

As described above, the second control apparatus comprises a target air-fuel ratio setting section (refer to FIGS. 11 and 12) which is configured so as to set, based on the output value Voxs of the downstream air-fuel ratio sensor 67, the target upstream air-fuel ratio abyfr which is the target value of the air-fuel ratio of the gas flowing into the catalyst 43 to "the target rich air-fuel ratio afRich and the target lean air-fuel ratio afLean", alternately.

Further, the target air-fuel ratio setting section is configured:

so as to obtain the estimated adsorbed amount of the evaporated fuel (1−FGPG) which is a value corresponding to the amount of the evaporated fuel adsorbed in the canister 52;

so as to set the target rich air-fuel ratio afRich to the "first target rich air-fuel ratio smaller than the stoichiometric air-fuel ratio (the target rich air-fuel ratio determined at step 640 shown in FIG. 12)" (refer to step 640 shown in FIG. 12) and set the target lean air-fuel ratio afLean to the "first target lean air-fuel ratio larger than the stoichiometric air-fuel ratio (the target lean air-fuel ratio determined at step 650 shown in FIG. 12)" (refer to step 650 shown in FIG. 12), when the estimated adsorbed amount of the evaporated fuel (1−FGPG) is smaller than the predetermined amount Lth; and so as to set the target rich air-fuel ratio afRich to the "second target rich air-fuel ratio smaller than the first target rich air-fuel ratio by the value afR" (refer to step 1210 and step 1220, shown in FIG. 12) and set the target lean air-fuel ratio afLean to the "second target lean air-fuel ratio larger than the first target lean air-fuel ratio by the value afL" (refer to step 1230 and step 1240, shown in FIG. 12), when the estimated adsorbed amount of the evaporated fuel (1−FGPG) is equal to or larger than the predetermined amount Lth.

Further, the evaporated fuel purge amount control section of the second control apparatus is configured so as to increase the purge amount as the magnitude (air-fuel ratio change amount ΔAF=afLean−afRich) of the difference between the target lean air-fuel ratio and the target rich air-fuel ratio becomes larger (refer to steps from step 930 to step 970), similarly to the evaporated fuel purge amount control section of the first control apparatus.

Accordingly, the purge amount can be increased, as an amount of the evaporated fuel which is adsorbed in the canister 52 (estimated adsorbed amount of the evaporated fuel) comes closer to the canister saturated evaporated fuel amount. Thus, it is possible to provide the canister 52 with a capacity/room to adsorb a "certain (fair) amount of the evaporated fuel." Therefore, even when a large amount of the evaporated fuel suddenly/rapidly generates in the fuel tank 51, there is a high possibility of causing such an evaporated fuel to be adsorbed into the canister 52. Consequently, a possibility that the evaporated fuel is discharged into the air can be reduced.

In addition, as the purge amount becomes larger, the target lean air-fuel ratio afLean becomes a larger air-fuel ratio and the target rich air-fuel ratio afRich becomes a smaller air-fuel ratio. Accordingly, a "possibility that the emission worsens due to the purge of the evaporated fuel" can be reduced.

It should be noted that the second control apparatus may be configured so as to omit step 1210, and set the value afR used in step 1220 to a value which becomes larger (i.e., in such a manner that the target rich air-fuel ratio afRich becomes smaller) as the estimated adsorbed amount of the evaporated fuel (1−FGPG) becomes larger. Similarly, the second control apparatus may be configured so as to omit step 1230, and set the value afL used in step 1240 to a value which becomes larger (i.e., in such a manner that the target lean air-fuel ratio afLean becomes larger) as the estimated adsorbed amount of the evaporated fuel (1−FGPG) becomes larger.

In addition, the second control apparatus may be configured so as to set the target upstream air-fuel ratio abyfr to a constant rich air-fuel ratio at step 640, and so as to set the target upstream air-fuel ratio abyfr to a constant lean air-fuel ratio at step 650.

In this case, the target air-fuel ratio setting section may be expressed as a section configured:

so as to obtain, as the operating state indicating value, the estimated adsorbed amount of the evaporated fuel (1−FGPG) which is a value corresponding to an amount of the evaporated fuel adsorbed in the canister 52;

so as to determine that the operating state indicating value is the first value when the estimated adsorbed amount of the evaporated fuel (1−FPG) is smaller than the predetermined amount Lth, and thus to set the target rich air-fuel ratio afRich to the "first target rich air-fuel ratio afRich1 smaller than the stoichiometric air-fuel ratio" and set the target lean air-fuel ratio to the "first target lean air-fuel ratio afLean1 larger than the stoichiometric air-fuel ratio", and so as to determine that the operating state indicating value is the second value when the estimated adsorbed amount of the evaporated fuel (1−FPG) is equal to or larger than the predetermined amount Lth, and thus to set the target rich air-fuel ratio afRich to the "second target rich air-fuel ratio afRich2 smaller than the first target rich air-fuel ratio" and set the target lean air-fuel ratio afLean to the "second target lean air-fuel ratio afLean2 larger than the first target lean air-fuel ratio" (refer to steps from step 1210 to step 1240).

As described above, each of the embodiments according to the present invention can carry out the purge of the evaporated fuel without worsening the emission. The present invention is not limited to the above-described embodiments, and may be modified in various manners without departing from the scope of the present invention. For example, the estimated adsorbed amount of the evaporated fuel may be estimated based on outputs from various sensors. More specifically, the control apparatus may comprise HC concentration sensor and a gas flow rate sensor at each of the tank port 52*a*, the purge port 52*b*, and the atmosphere port 52*c*. In addition, the control apparatus may accumulate/integrate a product of the gas flow rate and the HC concentration, at each of the ports, as each evaporated fuel passing amount. Further, the control apparatus may estimate the estimated adsorbed amount of the evaporated fuel by subtracting, from the evaporated fuel passing amount at the tank port 52*a*, both the evaporated fuel passing amount at the purge port 52*b* and the evaporated fuel passing amount at the atmosphere port 52*c*.

Furthermore, it can be expressed that each of the control apparatuses of the above embodiments is configured (refer to step 640 and step 650):

so as to more greatly decrease the target rich air-fuel ratio afRich in a range smaller than the stoichiometric air-fuel ratio and more greatly increase the target lean air-fuel ratio afLean in a range larger than the stoichiometric air-fuel ratio, as the operating state indicating value becomes larger, or so as to more greatly increase the target rich air-fuel ratio afRich in a range smaller than the stoichiometric air-fuel ratio and more greatly decrease the target lean air-fuel ratio afLean in a range larger than the stoichiometric air-fuel ratio, as the operating state indicating value becomes larger.

In addition, each of the control apparatuses of the above embodiments obtains the instructed fuel injection amount Fi by correcting the base fuel injection amount Fb(k) with the purge correction coefficient FPG, the main FB learning value KG, and the main feedback coefficient FAF, however, it may obtain the instructed fuel injection amount Fi by correcting the base fuel injection amount Fb(k) with the main feedback coefficient FAF only, or with the main FB learning value KG and the main feedback coefficient FAF.

The invention claimed is:

1. A control apparatus for an internal combustion engine comprising:

a catalyst disposed in an exhaust passage of said engine;

a downstream air-fuel ratio sensor disposed downstream of said catalyst in said exhaust passage;

a target air-fuel ratio setting section configured so as to set, based on an output value of said downstream air-fuel ratio sensor, a target upstream air-fuel ratio which is a target value of an air-fuel ratio of a gas flowing into said catalyst to a target rich air-fuel ratio and a target lean air-fuel ratio, alternately;

a fuel injection valve configured so as to inject a fuel to said engine;

a fuel injection control section configured so as to determine a fuel injection amount which is an amount of said fuel injected from said fuel injection valve in accordance with said target upstream air-fuel ratio, and so as to have said fuel injection valve inject said fuel of said determined fuel injection amount;

an evaporated fuel purge section configured so as to introduce an evaporated fuel generated in a fuel tank storing said fuel supplied to said fuel injection valve into an intake passage of said engine; and an evaporated fuel purge amount control section configured so as to control a purge amount which is an amount of said evaporated fuel introduced into said intake passage by said evaporated fuel purge section;

wherein, said target air-fuel ratio setting section is configured:

so as to set said target rich air-fuel ratio to a first target rich air-fuel ratio smaller than stoichiometric air-fuel ratio and set said target lean air-fuel ratio to a first target lean air-fuel ratio larger than the stoichiometric air-fuel ratio, when an operating state indicating value indicative of an operating state of said engine is equal to a first value; and so as to set said target rich air-fuel ratio to a second target rich air-fuel ratio smaller than said first target rich air-fuel ratio and set said target lean air-fuel ratio to a second target lean air-fuel ratio larger than said first target lean air-fuel ratio, when said operating state indicating value is equal to a second value different from said first value, and said evaporated fuel purge amount control section is configured so as to increase said purge amount as a magnitude of a difference between said target lean air-fuel ratio and said target rich air-fuel ratio becomes larger.

2. The control apparatus according to claim 1, wherein, said evaporated fuel purge section includes a canister, which is disposed in a purge passage communicating between said fuel tank and said intake passage, and which adsorbs said evaporated fuel generated in said fuel tank, and said target air-fuel ratio setting section is configured, so as to obtain, as said operating state indicating value, an estimated adsorbed amount of said evaporated fuel which is a value corresponding to an amount of said evaporated fuel adsorbed in said canister;

so as to determine that said operating state indicating value is equal to said first value when said estimated adsorbed amount of said evaporated fuel is smaller than a predetermined amount; and so as to determine that said operating state indicating value is equal to said second value when said estimated adsorbed amount of said evaporated fuel is equal to or larger than said predetermined amount.

3. A control apparatus for an internal combustion engine comprising:

a catalyst disposed in an exhaust passage of said internal combustion engine;

a downstream air-fuel ratio sensor disposed downstream of said catalyst in said exhaust passage;

a target air-fuel ratio setting section configured so as to set, based on an output value of said downstream air-fuel ratio sensor, a target upstream air-fuel ratio which is a target value of an air-fuel ratio of a gas flowing into said catalyst to a target rich air-fuel ratio and a target lean air-fuel ratio, alternately;

a fuel injection valve configured so as to inject a fuel to said engine;

a fuel injection control section configured so as to determine a fuel injection amount which is an amount of said fuel injected from said fuel injection valve in accordance with said target upstream air-fuel ratio, and so as to have said fuel injection valve inject said fuel of said determined fuel injection amount;

an evaporated fuel purge section configured so as to introduce an evaporated fuel generated in a fuel tank storing said fuel supplied to said fuel injection valve into an intake passage of said engine; and an evaporated fuel purge amount control section configured so as to control a purge amount which is an amount of said evaporated fuel introduced into said intake passage by said evaporated fuel purge section, wherein, said evaporated fuel purge section includes a canister, which is disposed in a purge passage communicating between said fuel tank and said intake passage, and which adsorbs said evaporated fuel generated in said fuel tank, said target air-fuel ratio setting section is configured:

so as to obtain an estimated adsorbed amount of said evaporated fuel which is a value indicative of an amount of said evaporated fuel adsorbed in said canister;

so as to set said target rich air-fuel ratio to a first target rich air-fuel ratio smaller than stoichiometric air-fuel ratio and set said target lean air-fuel ratio to a first target lean air-fuel ratio larger than the stoichiometric air-fuel ratio, when said estimated adsorbed amount of said evaporated fuel is smaller than a predetermined amount; and so as to set said target rich air-fuel ratio to a second target rich air-fuel ratio smaller than said first target rich air-fuel ratio and set said target lean air-fuel ratio to a second target lean air-fuel ratio larger than said first target lean air-fuel ratio, when said estimated adsorbed amount of said evaporated fuel is equal to or larger than said predetermined amount, and said evaporated fuel purge amount control section is configured so as to increase said purge amount as a magnitude of a difference between said target lean air-fuel ratio and said target rich air-fuel ratio becomes larger.

* * * * *